US011747059B2

(12) United States Patent
Inoue et al.

(10) Patent No.: US 11,747,059 B2
(45) Date of Patent: Sep. 5, 2023

(54) HEAT EXCHANGER

(71) Applicant: DAIKIN INDUSTRIES, LTD., Osaka (JP)

(72) Inventors: Satoshi Inoue, Osaka (JP); Shun Yoshioka, Osaka (JP); Yoshio Oritani, Osaka (JP); Tomohiko Sakamaki, Osaka (JP); Tomoya Yamaguchi, Osaka (JP); Tomoki Hirokawa, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 268 days.

(21) Appl. No.: 16/498,797

(22) PCT Filed: Mar. 29, 2018

(86) PCT No.: PCT/JP2018/013487
§ 371 (c)(1),
(2) Date: Sep. 27, 2019

(87) PCT Pub. No.: WO2018/181828
PCT Pub. Date: Oct. 4, 2018

(65) Prior Publication Data

US 2020/0025428 A1 Jan. 23, 2020

(30) Foreign Application Priority Data

Mar. 29, 2017 (JP) ..... 2017-064880
Sep. 29, 2017 (JP) ..... 2017-191793

(51) Int. Cl.
*F28F 9/02* (2006.01)
*F25B 39/02* (2006.01)
(Continued)

(52) U.S. Cl.
CPC ..... *F25B 39/028* (2013.01); *F28F 9/0275* (2013.01); *F25B 2341/0011* (2013.01);
(Continued)

(58) Field of Classification Search
CPC ..... F28F 9/02; F28F 9/0221; F28F 9/0224; F28F 9/0278
See application file for complete search history.

(56) References Cited

U.S. PATENT DOCUMENTS 5,107,926 A * 4/1992 Calleson ..... F28D 1/05383 165/153
5,133,299 A * 7/1992 Rogan ..... F22B 1/025 122/406.3
(Continued)

FOREIGN PATENT DOCUMENTS

JP 2008-286488 A 11/2008
JP 2009144997 A * 7/2009
(Continued)

OTHER PUBLICATIONS

International Search Report issued in International Application No. PCT/JP2018/013487, dated Jun. 26, 2018 (4 pages).
(Continued)

*Primary Examiner* — Eric S Ruppert
(74) *Attorney, Agent, or Firm* — Osha Bergman Watanabe & Burton LLP

(57) ABSTRACT

A heat exchanger includes: heat transfer tubes aligned with one another; a header connected to end portions of the heat transfer tubes; and fins joined to the heat transfer tubes. When viewed in a longitudinal direction of the header and when the heat exchanger is used as an evaporator, the header is divided into: a circulation space including a first space in which refrigerant flows in a first direction along the longitudinal direction of the header and a second space in which the refrigerant flows in a second direction opposite to the first direction along the longitudinal direction; and an insertion space into which the heat transfer tubes are inserted. The header includes: a circulation division plate that divides the
(Continued)

first space from the second space; and an insertion space forming plate that divides the circulation space from the insertion space.

17 Claims, 18 Drawing Sheets

(51) Int. Cl.
*F28D 1/03* (2006.01)
*F28D 1/053* (2006.01)
*F28F 27/02* (2006.01)

(52) U.S. Cl.
CPC ..... *F28D 1/0333* (2013.01); *F28D 1/05375* (2013.01); *F28F 27/02* (2013.01); *F28F 2275/04* (2013.01)

(56) References Cited

U.S. PATENT DOCUMENTS

2010/0314090 A1* 12/2010 Moriya ..... F25B 39/028 165/174
2013/0126140 A1 5/2013 Park et al.
2016/0223265 A1 8/2016 Jindou et al.
2016/0238322 A1* 8/2016 Inoue ..... F28F 9/027
2017/0292741 A1 10/2017 Inoue et al.

FOREIGN PATENT DOCUMENTS

JP 2014-37899 A 2/2014
JP 2014052135 A * 3/2014
JP 2014-126273 A 7/2014
JP 2014-533819 A 12/2014
JP 2015-068622 A 4/2015
JP 2015-78833 A 4/2015
JP 2015127618 A * 7/2015 ..... F28F 1/32
JP 2016-125748 A 7/2016
WO WO-2015045564 A1 * 4/2015 ..... F28D 1/0471
WO 2016/052299 A1 4/2016

OTHER PUBLICATIONS

Extended European Search Report issued in corresponding European Patent Application No. 18774476.8 dated Oct. 15, 2020 (7 pages).
International Preliminary Report on Patentability issued in corresponding International Patent Application No. PCT/JP2018/013487, dated Oct. 10, 2019 (13 pages).

* cited by examiner

HEAT EXCHANGER

TECHNICAL FIELD

The present invention relates to a heat exchanger.

BACKGROUND

A heat exchanger has been known that includes a plurality of multiport flat tubes, fins joined to the plurality of multiport flat tubes, and a header that is connected to the ends of the plurality of multiport flat tubes and that causes refrigerant flowing inside the multiport flat tubes to exchange heat with the air flowing outside the multiport flat tubes.

For example, PTL 1 (Japanese Unexamined Patent Application Publication No. 2015-068622) describes a heat exchanger with a structure in which refrigerant can be circulated in the header such that the flow of the refrigerant can be divided in the up-down direction in both high circulation amount environment and low circulation amount environment.

In the heat exchanger disclosed in PTL 1, the flow path cross-sectional area of a portion where the refrigerant circulates changes in accordance with the insertion depth of the heat transfer tube into the header.

However, the insertion depth of the heat transfer tube into the header is likely to have an error at the time of manufacture, and there is a possibility that the intended flow path cross-sectional area cannot be obtained at the portion where the refrigerant circulates.

PATENT LITERATURE

PTL 1: Japanese Unexamined Patent Application Publication No. 2015-068622

SUMMARY

One or more embodiments of the present invention provide a heat exchanger capable of reducing the placement error of the heat transfer tube at the time of manufacture.

A heat exchanger according to one or more embodiments includes a plurality of heat transfer tubes, a header, and a plurality of fins. The plurality of heat transfer tubes are arranged with each other. End portions of the heat transfer tubes are connected to the header. The plurality of fins are joined to the heat transfer tubes. As viewed in the longitudinal direction of the header, the header is divided into a circulation space and an insertion space. When the heat exchanger is used as an evaporator, the circulation space includes a first space in which refrigerant flows in a first direction along the longitudinal direction of the header and a second space in which the refrigerant flows in a second direction that is a direction along the longitudinal direction of the header and that is opposite to the first direction. The heat transfer tubes are inserted into the insertion space. The header includes a circulation member and an insertion space forming member (insertion space forming plate). The circulation member divides the first space from the second space. The insertion space forming member divides the circulation space from the insertion space.

Note that examples of the insertion space forming member include a member which extends from the insertion space to the circulation space in a direction intersecting with the longitudinal direction of the header or extends perpendicularly to the longitudinal direction of the header, a member which extends in the longitudinal direction of the header between the circulation space and the insertion space, a structure provided with both of them, and a member constituted by a plurality of members.

Note that the term "division" is used to form different refrigerant spaces by causing a difference in the flow of the refrigerant and divide a refrigerant space into two refrigerant spaces such that the two refrigerant spaces have a communication portion that enables the refrigerant to directly move between the two refrigerant spaces. That is, it is desirable that at least part of the insertion space forming member constitute the contour of the circulation space, as viewed in the longitudinal direction of the header.

According to the heat exchanger, since the circulation space inside the header is divided into the first space and the second space by the circulation member, the refrigerant passage area of the first space can be reduced, as compared with the case where no such circulation member is provided. For this reason, even when the circulation amount of the refrigerant in the heat exchanger functioning as an evaporator is a low circulation amount, a greater amount of the refrigerant that has flowed into the first space can be made to reach the first direction side of the header, where the first direction extends along the longitudinal direction of the header. As a result, even when the circulation amount of the refrigerant is a low circulation amount, a sufficient amount of the refrigerant can be supplied to the heat transfer tubes disposed on the first direction side.

In addition, in the header of the heat exchanger, the refrigerant can circulate in the circulation space. Consequently, even when the refrigerant having a high specific gravity vigorously flows in the first space and tends to gather on the first direction side of the first space (for example, when the circulation amount of the refrigerant is a high circulation amount in the heat exchanger functioning as an evaporator), the refrigerant that has flowed to the first direction side in the first space can be made to flow in the second direction in the second space and, thus, can be returned to the first space again. Thus, even when the refrigerant vigorously flows and passes by the heat transfer tubes disposed on the second direction side in the first space in which the refrigerant flowing in the first direction has a high flow velocity, a sufficient amount of the refrigerant can be delivered to the heat transfer tubes by the circulation of refrigerant.

Here, in the case where the refrigerant is circulated in the header in the above-described manner and the heat transfer tube is connected to the first space side, if an error in the insertion length of the heat transfer tube into the header occurs during manufacture of the heat exchanger, it is difficult to maintain the intended refrigerant passage area in the first space. Similarly, even when the heat transfer tube is connected to the second space side, it is difficult to maintain the intended refrigerant passage area in the second space if an error in the insertion length of the heat transfer tube into the header occurs during manufacture of the heat exchanger.

In contrast, according to the heat exchanger, an end of the heat transfer tube for insertion does not divide the first space or the second space, but the insertion space forming member divides the circulation space from the insertion space in which the ends of the heat transfer tubes are located. Thus, unintended refrigerant passage area of the first space or the second space caused by an error in the degree of insertion of the heat transfer tube can be prevented.

In a heat exchanger according to one or more embodiments, the first space is formed between the circulation member and the insertion space forming member in the longitudinal direction of the header.

According to the heat exchanger, the refrigerant passage area of the first space can be more reliably set to the intended flow path area by the insertion space forming member, and the refrigerant can more easily reach the first direction along the longitudinal direction of the header by more reliably reducing the first space.

In a heat exchanger according to one or more embodiments, the insertion space forming member is configured to include an insertion regulating member (insertion regulating plate) capable of regulating the degree of insertion of the heat transfer tube. The insertion regulating member is a member separated from portions of the header that constitute both ends of the first space in a direction perpendicular to an insertion direction of the heat transfer tube, as viewed in the longitudinal direction of the header.

Here, it is desirable that the insertion regulating member have a shape that does not enable an end portion of the heat transfer tube adjacent to the header to pass therethrough and is desirable that the insertion regulating member have an opening smaller than the end portion of the heat transfer tube. Note that the ends of the heat transfer tubes may be in contact with the insertion regulating member with the heat exchanger assembled, or a gap may be formed between each of the ends of the heat transfer tubes and the insertion regulating member.

According to the heat exchanger, by making the insertion regulating member a separate member from a member that constitutes part of the first space, a structure that prevents the refrigerant passage area of the first space in the header from having an unintended value can be easily achieved.

In a heat exchanger according to one or more embodiments, as viewed in the longitudinal direction of the header, the width of the first space is smaller than the width of the heat transfer tube in the direction perpendicular to the insertion direction of the heat transfer tube.

According to the heat exchanger, the amount of refrigerant required for forming the refrigerant circuit by using the heat exchanger can be reduced by reducing the size of the first space, which is a space that is difficult to contribute to heat exchange other than the internal space of the heat transfer tube of the heat exchanger.

In a heat exchanger according to one or more embodiments, as viewed in the longitudinal direction of the header, the header includes a second space forming member (falling space forming column) that forms at least part of the contour of the second space as a member separated from the circulation member.

According to the heat exchanger, since the second space forming member and the circulating member are different members, the second space can be easily formed.

In a heat exchanger according to one or more embodiments, the second space forming member constitutes at least both ends of the second space in a direction perpendicular to an insertion direction of the heat transfer tube as viewed in the longitudinal direction of the header. In the direction perpendicular to the insertion direction of the heat transfer tube as viewed in the longitudinal direction of the header, a width of the second space is smaller than a width of the first space.

According to the heat exchanger, by reducing the refrigerant passage area of the second space that constitutes the side opposite to the first space side to which the heat transfer tubes are connected in the header, the amount of refrigerant located inside of the second space is reduced. Thus, the amount of refrigerant required when a refrigerant circuit is configured by using a heat exchanger can be reduced.

In a heat exchanger according to one or more embodiments, the second space forming member constitutes at least both ends of the second space in a direction perpendicular to an insertion direction of the heat transfer tube as viewed in the longitudinal direction of the header. In the direction perpendicular to the insertion direction of the heat transfer tube as viewed in the longitudinal direction of the header, the width of the second space is larger than a width of the first space.

According to the heat exchanger, a pressure loss of the refrigerant passing through the second space can be reduced by increasing the refrigerant passage area of the second space.

In a heat exchanger according to one or more embodiments, the circulation space is connected with the insertion space through connection spaces in the header. A connection location of the insertion space with the connection spaces is eccentrically located on a windward side in a direction perpendicular to an insertion direction of the heat transfer tube as viewed in the longitudinal direction of the header.

As used herein, the term "being eccentrically located on the windward side" means that in the direction perpendicular to the insertion direction of the heat transfer tube as viewed in the longitudinal direction of the header, the center of the connection space is located on the windward side of the center of the insertion space. Note that in the vicinity of the heat transfer tubes, it is desirable that as viewed in the longitudinal direction of the header, the heat exchanger be used such that the air flow generated by the fan is supplied in a direction intersecting with the longitudinal direction of the heat transfer tube.

According to the heat exchanger, a larger amount of refrigerant that has passed through the connection space can be sent to the windward side of the insertion space. As a result, the performance of the heat exchanger can be improved.

In a heat exchanger according to one or more embodiments, the insertion space forming member is configured to include a plate member that extends between the circulation space and the insertion space. The connection spaces are provided as pass-through portions of the plate member in a thickness direction.

According to the heat exchanger, by providing the connection space as a pass-through portion of the plate member, the connection space can be formed for each of the plurality of heat transfer tubes by a single plate member.

In a heat exchanger according to one or more embodiments, the circulation space and the insertion space are connected with each other through connection opening surfaces in the header. The connection opening surfaces of the insertion space are eccentrically located on a windward side in a direction perpendicular to an insertion direction of the heat transfer tube as viewed in the longitudinal direction of the header. In the direction perpendicular to the insertion direction of the heat transfer tube as viewed in the longitudinal direction of the header, both ends of the connection opening surface are formed by a member that forms the circulation space.

According to the heat exchanger, the performance of the heat exchanger can be increased by leading the refrigerant that has flowed through the circulation space to the windward side of each of the insertion spaces. In addition, the structure of the connection opening surface can be achieved by using a member that forms the circulation space.

In a heat exchanger according to one or more embodiments, in an inner peripheral portion of the header, an inner peripheral portion of the insertion space is semi-circular in shape as viewed in the longitudinal direction of the header. In a direction perpendicular to the longitudinal direction of the heat transfer tube as viewed in the longitudinal direction of the header, a gap is formed between an end of the heat transfer tube and the inner peripheral portion in the semi-circular shape.

According to the heat exchanger, in the case where the header shape includes a semicircular inner peripheral portion, even when a gap is formed between each of the end portions of the heat transfer tube in the direction perpendicular to the longitudinal direction of the heat transfer tube (for example, the front and rear end portions in the air flow direction) and the semi-circular inner peripheral portion, the gap can be excluded from the circulation space by providing the insertion space forming member. As a result, the refrigerant can be prevented from flowing in the gap in the longitudinal direction of the header.

In a heat exchanger according to one or more embodiments, the insertion space forming member extends in the insertion space between adjacent two of the heat transfer tubes.

According to the heat exchanger, the insertion space forming member provided so as to extend between adjacent two of the heat transfer tubes prevents the flow of the refrigerant in the longitudinal direction of the header. In this manner, the insertion space forming member can divide the circulation space from the insertion space. In addition, the flow of the refrigerant flowing in the circulation space branches into between the adjacent two of the insertion space forming members. Thus, the branched flow of refrigerant is easily led to a corresponding one of the heat transfer tubes.

In a heat exchanger according to one or more embodiments, the first space is formed between the circulation member and the insertion space forming member as viewed in the longitudinal direction of the header. The insertion space forming member extends in the insertion space between adjacent two of the heat transfer tubes. A first opening for generating a flow of the refrigerant in the first direction is formed at a second direction side of the first space. As viewed in the longitudinal direction of the header, the first opening does not overlap the insertion space forming member.

According to the heat exchanger, the refrigerant passage area of the first space can be more reliably set to the intended flow path area by the insertion space forming member, and a sufficient amount of the refrigerant can be moved in the first direction by narrowing the first space more. In addition, the insertion space forming member provided so as to extend between adjacent two of the heat transfer tubes can divide the first space from the insertion space by blocking the flow of the refrigerant in the longitudinal direction of the header. Furthermore, the flow of the refrigerant flowing in the first space in the first direction branches into between the insertion space forming members and, thus, each of the branched flows can be easily led to a corresponding one of the heat transfer tubes. Still furthermore, since the first opening and the insertion space forming member have a placement relationship so as not to overlap each other as viewed in the longitudinal direction of the header, a slowdown of the flow of the refrigerant that has passed through the first opening and that flows in the first direction caused by collision with the insertion space forming member can be prevented.

In a heat exchanger according to one or more embodiments, the insertion space forming member extends parallel to the circulation member so as to divide the circulation space from the insertion space.

According to the heat exchanger, a division member consists of the insertion space forming member, and a circulation flow of the refrigerant can be easily formed by flowing the refrigerant along the insertion space forming member.

In a heat exchanger according to one or more embodiments, the insertion space forming member is provided with a plurality of flow dividing openings each corresponding to the end portion of one of the heat transfer tubes.

According to the heat exchanger, the circulating flow of the refrigerant along the insertion space forming member is formed and, at the same time, the flow of the refrigerant can be branched into the heat transfer tubes through the flow dividing openings provided in the insertion space forming member.

A heat exchanger according to one or more embodiments is used together with the fan that generates an air flow. The opening area of each of the flow dividing openings provided in the insertion space forming member has a size that matches a predetermined wind speed distribution of the air flow generated by the fan.

According to the heat exchanger, the flow rates of the refrigerant sent to the heat transfer tubes can be matched to the wind speed distribution by the flow dividing openings provided in the insertion space forming member to have sizes matched to the wind speed distribution. As a result, the heat exchange performance can be improved.

In a heat exchanger according to one or more embodiments, the heat transfer tubes are arranged in the up-down direction. When the heat exchanger is used as an evaporator, the refrigerant flows upward in the first space and moves downward in the second space.

According to the heat exchanger, the circulation space inside the header is divided into a first space in which the refrigerant moves upward and a second space in which the refrigerant moves downward by the circulation member when the heat exchanger is used as an evaporator. For this reason, the refrigerant passage area of the first space in which the refrigerant moves upward against its own weight can be decreased. Consequently, even when the circulation amount of the refrigerant in the heat exchanger functioning as the evaporator is a low circulation amount, the refrigerant that has flowed into the first space is enabled to move upward against its weight and reach the upward portion.

In addition, according to the heat exchanger, the header can circulate the refrigerant in the circulation space. Consequently, even when the refrigerant having a high specific gravity vigorously flows upward in the first space and tends to gather on the upward side of the first space (for example, when the circulation amount of the refrigerant is a high circulation amount in the heat exchanger functioning as an evaporator), the refrigerant that has flowed to the upward side in the first space can be made to flow downward in the second space by its own weight and, thus, can be returned to the first space again. Thus, even when the refrigerant vigorously flows and passes by the heat transfer tubes in the downward portion of the first space in which the upward flow velocity of the refrigerant is high, a sufficient amount of the refrigerant can be delivered to the heat transfer tubes by the circulation of refrigerant.

In a heat exchanger according to one or more embodiments, the heat transfer tube is a flat tube.

According to the heat exchanger, a plurality of flat tubes can be stacked such that the flat portions of the flat tubes face each other.

A heat exchanger according to one or more embodiments includes a plurality of structures, each including the plurality of heat transfer tubes and the header, arranged in the air flow direction.

According to the heat exchanger, heat exchange of the refrigerant can be performed at a plurality of points in the air flow direction.

DETAILED DESCRIPTION

An outdoor unit serving as a heat exchange unit according to one or more embodiments and modifications of the embodiments are described below with reference to the accompanying drawings. Note that a specific structure of the outdoor unit serving as a heat exchange unit is not limited to that of the embodiments and the modifications of the embodiments described below. The structure can be changed within the sprit and scope of the embodiments and the modifications.

(1) Configuration of Air Conditioner Apparatus

Figure 1:
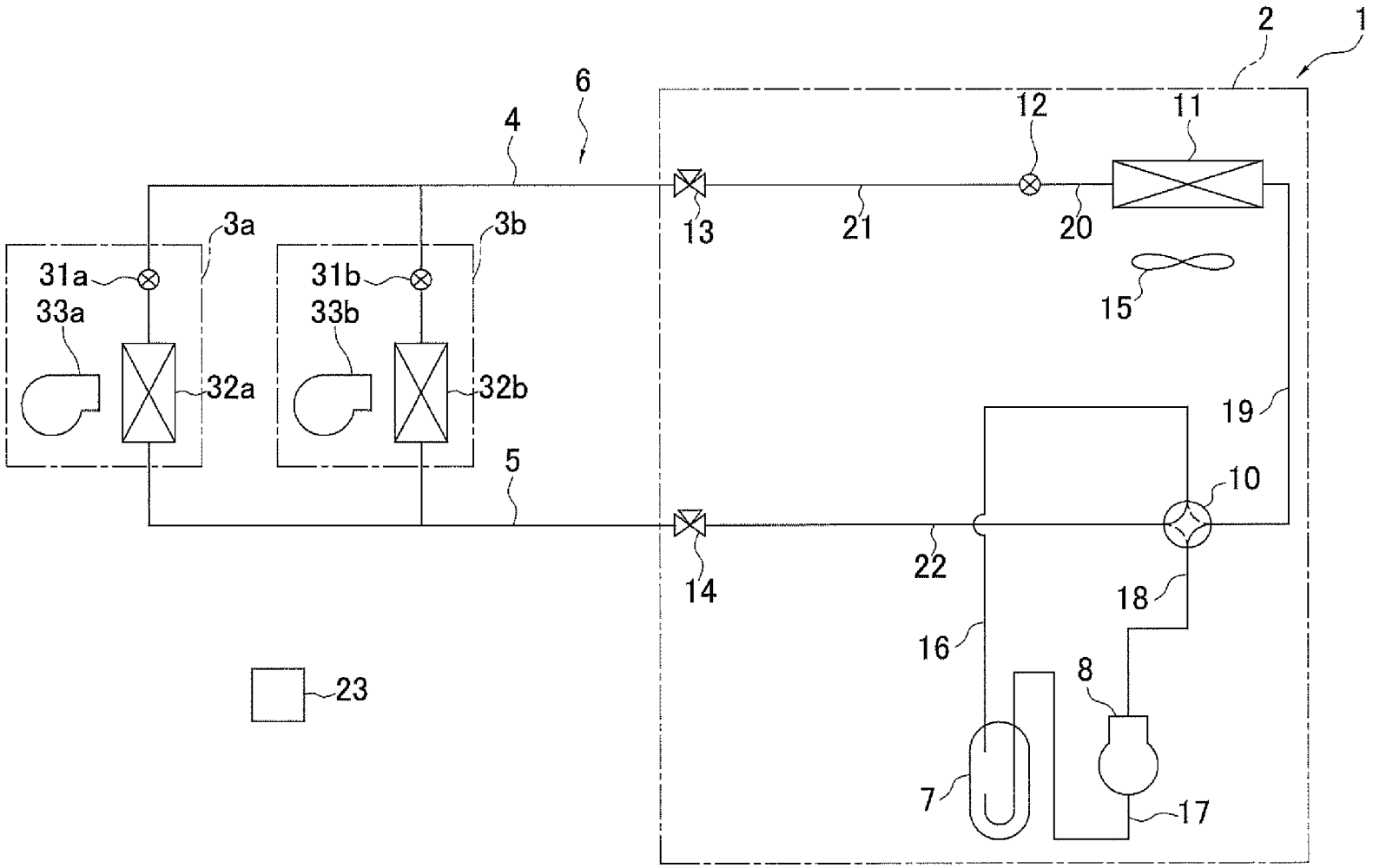
FIG. 1 is a schematic illustration of the configuration of an air conditioner apparatus that employs a heat exchanger according to one or more embodiments.

FIG. 1 is a schematic illustration of the configuration of an air conditioner apparatus 1 that employs an outdoor heat exchanger 11 serving as a heat exchanger according to one or more embodiments.

The air conditioner apparatus 1 is an apparatus capable of cooling and heating a room, such as a room in a building, by performing a vapor compression refrigeration cycle. The air conditioner apparatus 1 mainly includes an outdoor unit 2, indoor units 3*a*, 3*b*, a liquid-refrigerant connection pipe 4 that connects the outdoor unit 2 with each of the indoor units 3*a*, 3*b*, a gas-refrigerant connection pipe 5, and a control unit 23 that controls components of the outdoor unit 2 and the indoor units 3*a*, 3*b*. In addition, a vapor compression refrigerant circuit 6 of the air conditioner apparatus 1 is configured by connecting the outdoor unit 2 with each of the indoor units 3*a*, 3*b* via the liquid-refrigerant connection pipe 4 and the gas-refrigerant connection pipe 5.

The outdoor unit 2 is installed outdoors (for example, on the roof of a building or in the vicinity of a wall surface of a building) and constitutes part of the refrigerant circuit 6. The outdoor unit 2 mainly includes an accumulator 7, a compressor 8, a four-way switching valve 10, an outdoor heat exchanger 11, an outdoor expansion valve 12 serving as an expansion mechanism, a liquid-side shutoff valve 13, a gas-side shutoff valve 14, and an outdoor fan 15. Each of the devices is connected to one of the valves via one of refrigerant pipes 16 to 22.

The indoor units 3*a* and 3*b* are installed indoors (for example, in a room or a space above the ceiling) and constitute part of the refrigerant circuit 6. The indoor unit 3*a* mainly includes an indoor expansion valve 31*a*, an indoor heat exchanger 32*a*, and an indoor fan 33*a*. The indoor unit 3*b* mainly includes an indoor expansion valve 31*b* serving as an expansion mechanism, an indoor heat exchanger 32*b*, and an indoor fan 33*b*.

The liquid-refrigerant connection pipe 4 and the gas-refrigerant connection pipe 5 are refrigerant pipes that are installed on site when the air conditioner apparatus 1 is installed at an installation place, such as a building. One end of the liquid-refrigerant connection pipe 4 is connected to the liquid-side shutoff valve 13 of the outdoor unit 2, and the other end of the liquid-refrigerant connection pipe 4 is connected to the liquid-side end of each of the indoor expansion valves 31*a* and 31*b* of the indoor units 3*a* and 3*b*.

One end of the gas-refrigerant connection pipe 5 is connected to the gas-side shutoff valve 14 of the outdoor unit 2, and the other end of the gas-refrigerant connection pipe 5 is connected to the gas-side end of each of the indoor heat exchangers 32*a* and 32*b* of the indoor units 3*a* and 3*b*.

The control unit 23 is configured by communication-connecting, for example, control boards (not illustrated) provided on the outdoor unit 2 and the indoor units 3*a* and 3*b* with one another. Note that in FIG. 1, for the purpose of convenience, the control unit 23 is located away from the outdoor unit 2 and the indoor units 3*a* and 3*b*. The control unit 23 controls the constituent devices (8, 10, 12, 15, 31*a*, 31*b*, 33*a*, 33*b*) of the air conditioner apparatus 1 (in this example, the outdoor unit 2 and the indoor units 3*a*, 3*b*), that is, the control unit 23 performs overall operation control of the air conditioner apparatus 1.

(2) Operation Performed by Air Conditioner Apparatus

The operation performed by the air conditioner apparatus 1 is described below with reference to FIG. 1. In the air conditioner apparatus 1, a cooling operation and a heating operation are performed. The cooling operation flows refrigerant from the compressor 8 to the indoor heat exchangers 32*a*, 32*b* via the outdoor heat exchanger 11, the outdoor expansion valve 12, and the indoor expansion valves 31*a*, 31*b*. The heating operation flows the refrigerant from the compressor 8 to the outdoor heat exchanger 11 via the indoor heat exchangers 32*a*, 32*b*, the indoor expansion valve 31*a*, 31*b*, and the outdoor expansion valve 12. Note that the cooling operation and the heating operation are performed by the control unit 23.

During the cooling operation, the four-way switching valve 10 is switched to the outdoor heat radiation mode (the mode denoted by a solid line in FIG. 1). In the refrigerant circuit 6, the low-pressure gas refrigerant in the refrigeration cycle is sucked into the compressor 8 and is compressed to a high pressure in the refrigeration cycle. Thereafter, the gas refrigerant is discharged. The high-pressure gas refrigerant discharged from the compressor 8 is sent to the outdoor heat exchanger 11 through the four-way switching valve 10. The high-pressure gas refrigerant sent to the outdoor heat exchanger 11 exchanges heat with the outdoor air supplied as a cooling source by the outdoor fan 15 in the outdoor heat exchanger 11 functioning as a refrigerant radiator. Thus, the gas refrigerant dissipates heat and turns into a high-pressure liquid refrigerant. The high-pressure liquid refrigerant that has dissipated heat in the outdoor heat exchanger 11 is sent to the indoor expansion valves 31*a*, 31*b* through the outdoor expansion valve 12, the liquid-side shutoff valve 13, and the liquid-refrigerant connection pipe 4. The refrigerant sent to the indoor expansion valves 31*a*, 31*b* is depressurized to a low pressure of the refrigeration cycle by the indoor expansion valves 31*a*, 31*b* and turns into a low-pressure gas-liquid two-phase state refrigerant. The low-pressure gas-liquid two-phase state refrigerant that has been depressurized by the indoor expansion valves 31*a*, 31*b* is sent to the indoor heat exchangers 32*a*, 32*b*. The low-pressure gas-liquid two-phase state refrigerant sent to the indoor heat exchangers 32*a*, 32*b* exchanges heat with the indoor air supplied by the indoor fans 33*a*, 33*b* as a heating source in the indoor heat exchangers 32*a*, 32*b*. Thus, the refrigerant evaporates. As a result, the room air is cooled and, thereafter, the cooled room air is supplied to the room. In this manner, the room is cooled. The low-pressure gas refrigerant evaporated in the indoor heat exchangers 32*a*, 32*b* is again sucked into the compressor 8 via the gas-refrigerant connection pipe 5, the gas-side shutoff valve 14, the four-way switching valve 10, and the accumulator 7.

During the heating operation, the four-way switching valve 10 is switched to the outdoor evaporation mode (the mode denoted by a broken line in FIG. 1). In the refrigerant circuit 6, the low-pressure gas refrigerant in the refrigeration cycle is sucked into the compressor 8 and is compressed to a high pressure of the refrigeration cycle. Thereafter, the gas refrigerant is discharged. The high-pressure gas refrigerant discharged from the compressor 8 is sent to the indoor heat exchangers 32*a*, 32*b* through the four-way switching valve 10, the gas-side shutoff valve 14, and the gas-refrigerant connection pipe 5. The high-pressure gas refrigerant sent to the indoor heat exchangers 32*a*, 32*b* exchanges heat with the indoor air supplied as a cooling source by the indoor fans 33*a*, 33*b* in the indoor heat exchangers 32*a*, 32*b*. Thus, the gas refrigerant dissipates heat and turns into a high pressure liquid refrigerant. As a result, the room air is heated and, thereafter, is supplied into the room to heat the room. The high-pressure liquid refrigerant that has dissipated heat by the indoor heat exchangers 32*a*, 32*b* is sent to the outdoor expansion valve 12 through the indoor expansion valves 31*a*, 31*b*, the liquid-refrigerant connection pipe 4, and the liquid-side shutoff valve 13. The refrigerant sent to the outdoor expansion valve 12 is decompressed to the low pressure of the refrigeration cycle by the outdoor expansion valve 12 and turns into a low-pressure gas-liquid two-phase state refrigerant. The low-pressure gas-liquid two-phase state refrigerant having a pressure reduced by the outdoor expansion valve 12 is sent to the outdoor heat exchanger 11. The low-pressure gas-liquid two-phase state refrigerant sent to the outdoor heat exchanger 11 exchanges heat with outdoor air supplied as a heat source by the outdoor fan 15 in the outdoor heat exchanger 11 functioning as an evaporator of the refrigerant. Thus, the refrigerant evaporates and turns into a low pressure gas refrigerant. The low-pressure refrigerant evaporated in the outdoor heat exchanger 11 is again sucked into the compressor 8 through the four-way switching valve 10 and the accumulator 7.

(3) Configuration of Outdoor Unit

Figure 2:
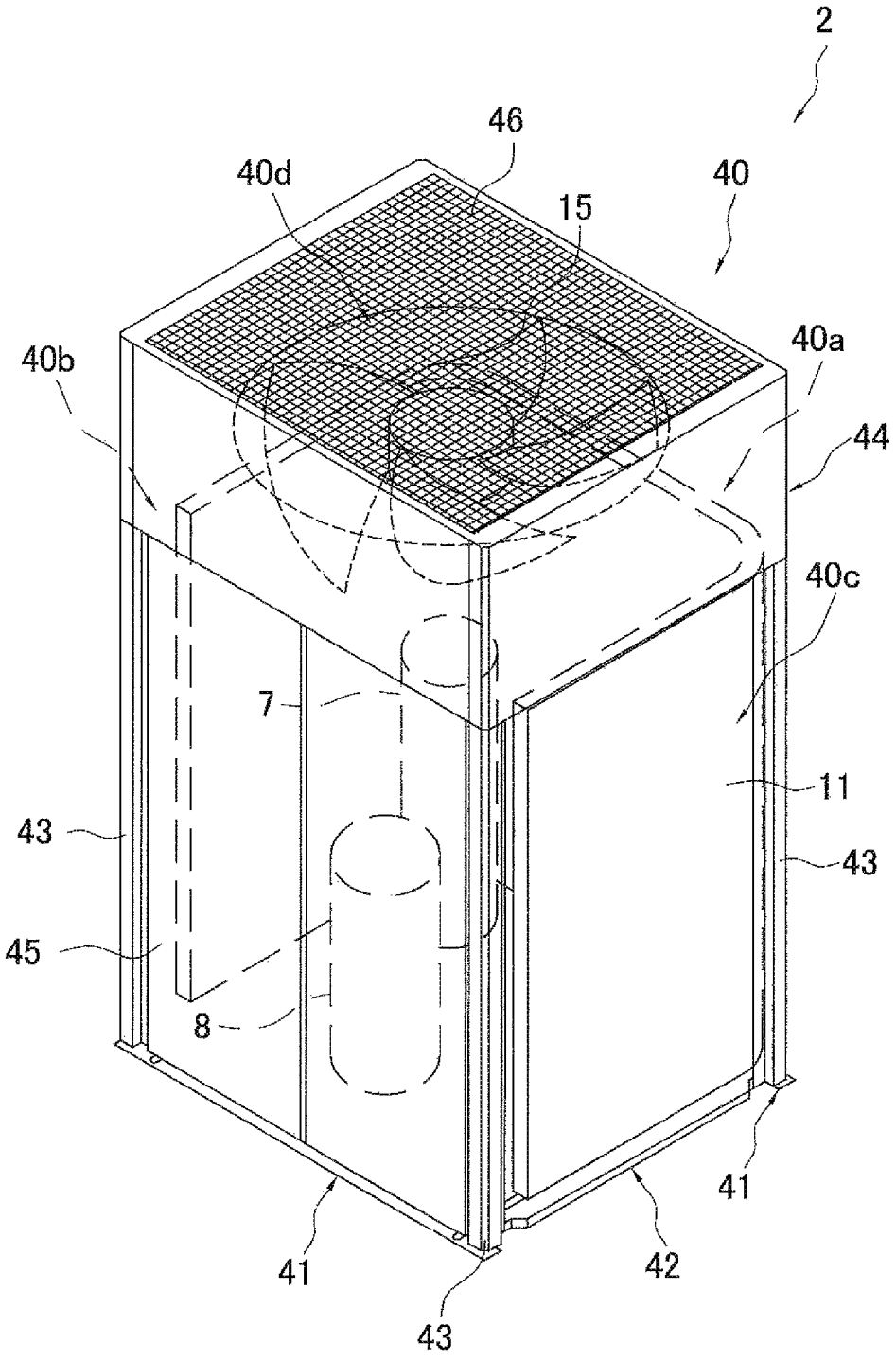
FIG. 2 is an external perspective view of an outdoor unit.
Figure 3:
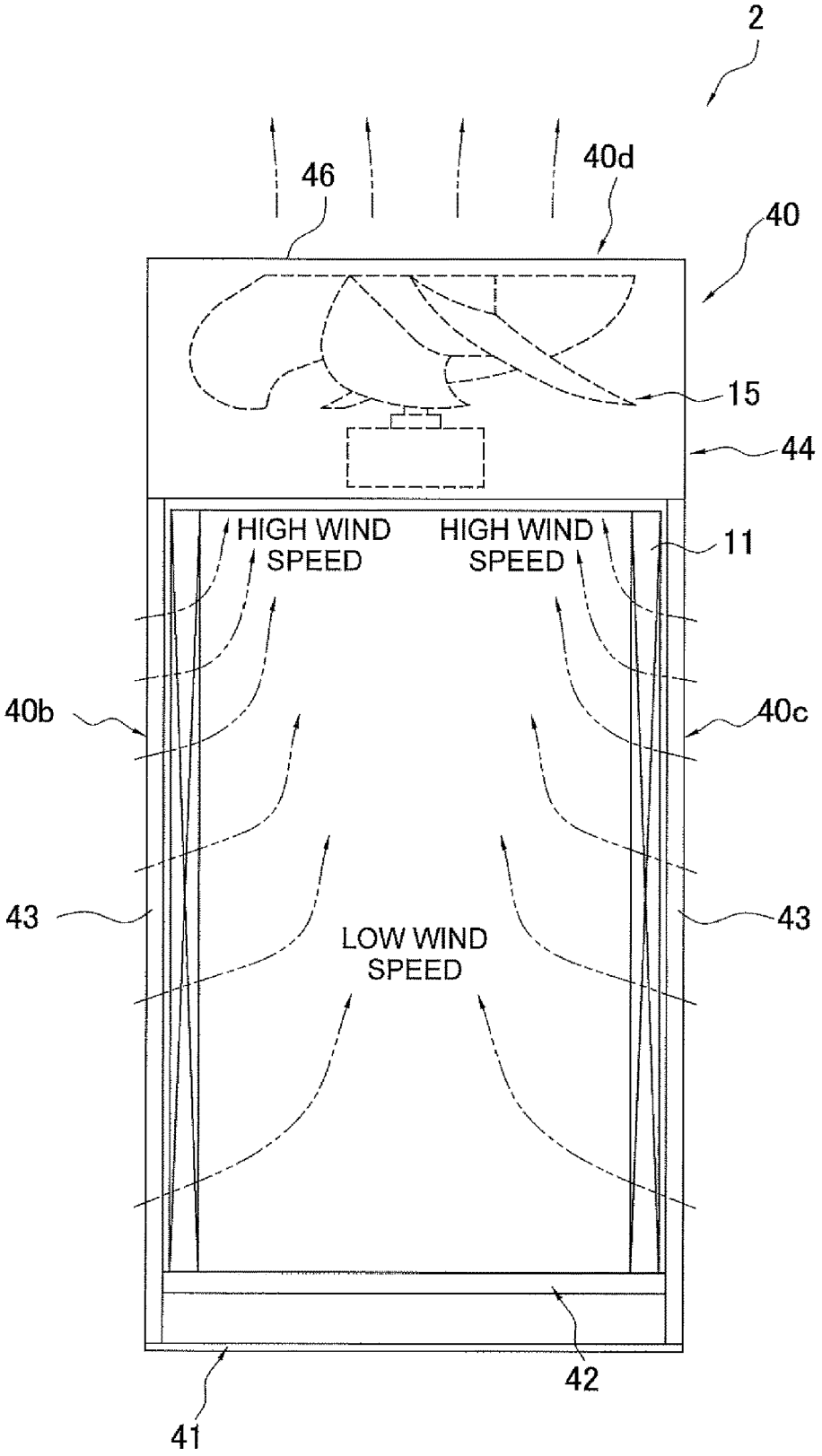
FIG. 3 is a front view of the outdoor unit (with refrigerant circuit components other than an outdoor heat exchanger removed).
Figure 4:
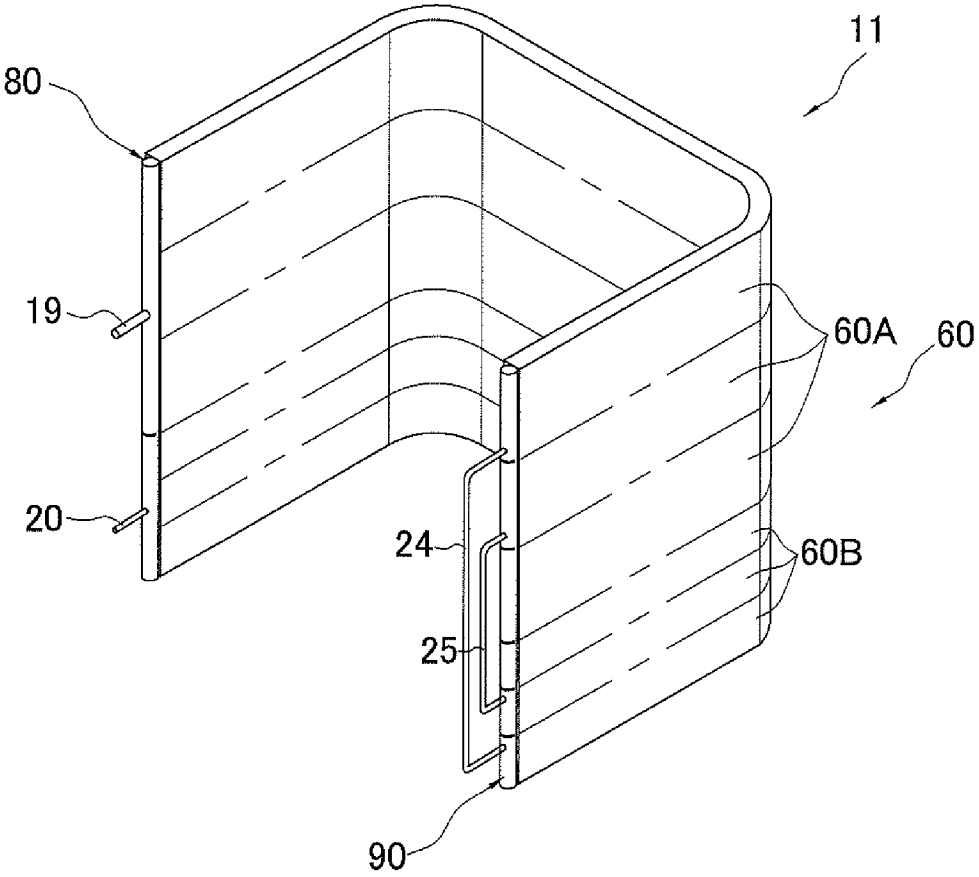
FIG. 4 is a schematic perspective view of the outdoor heat exchanger.
Figure 5:
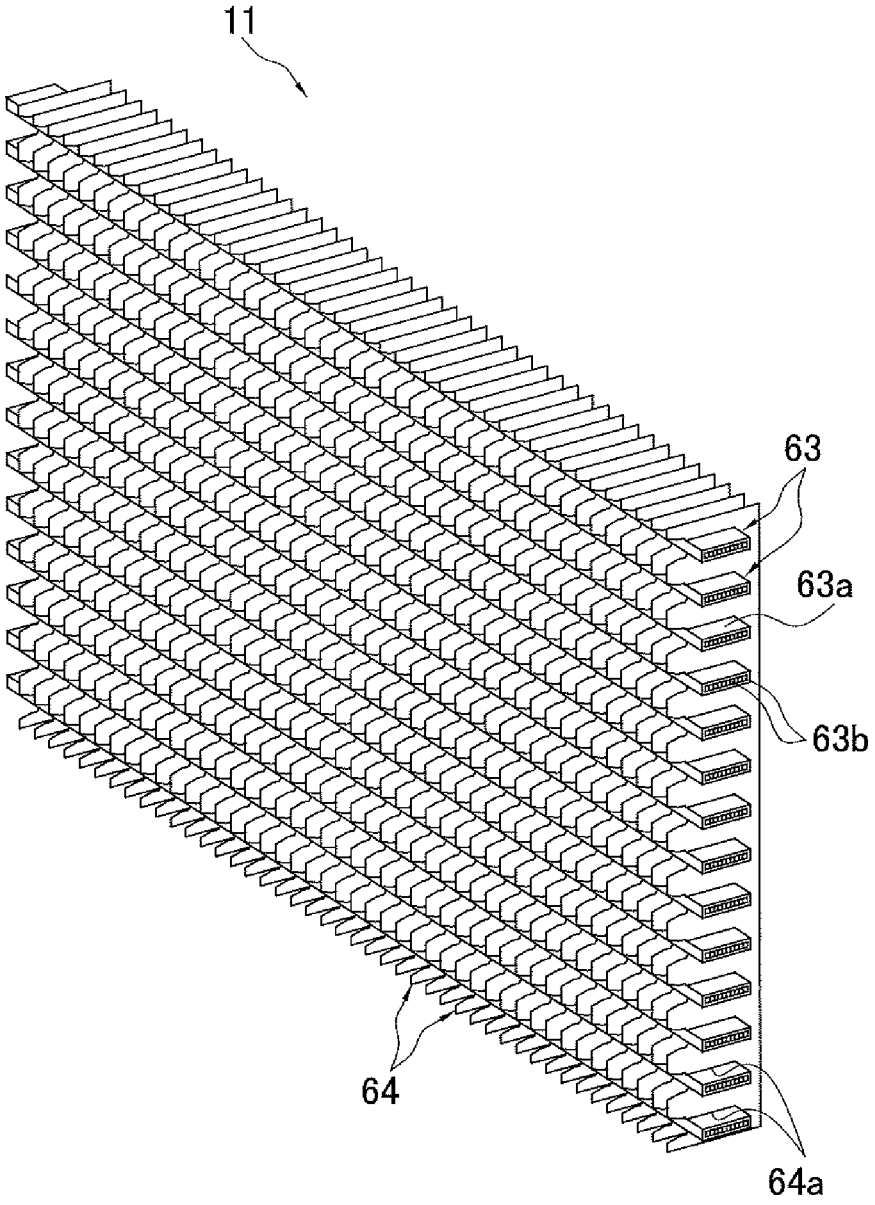
FIG. 5 is a partial enlarged view of a heat exchange unit illustrated in FIG. 4.
Figure 6:
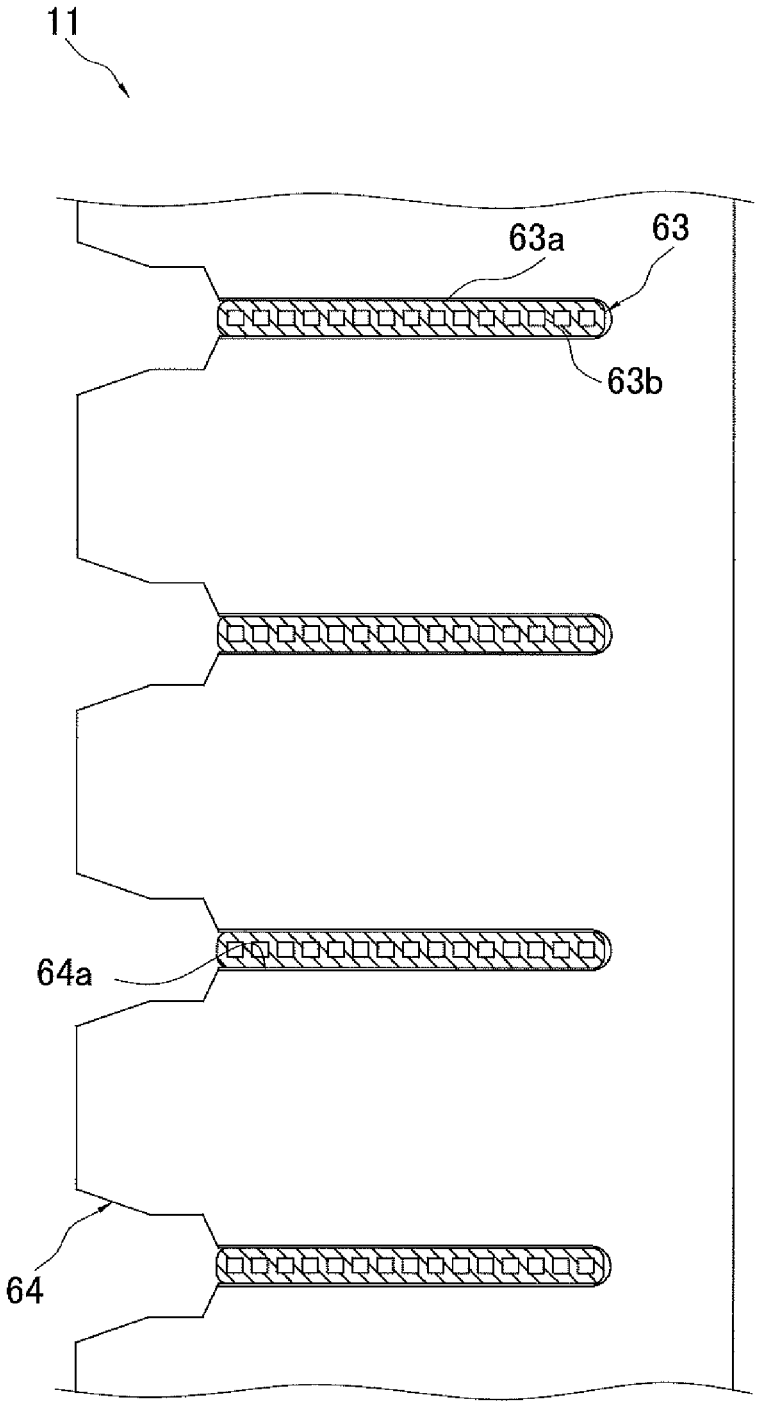
FIG. 6 is a schematic illustration of heat transfer fins attached to a multiport flat tube.
Figure 7:
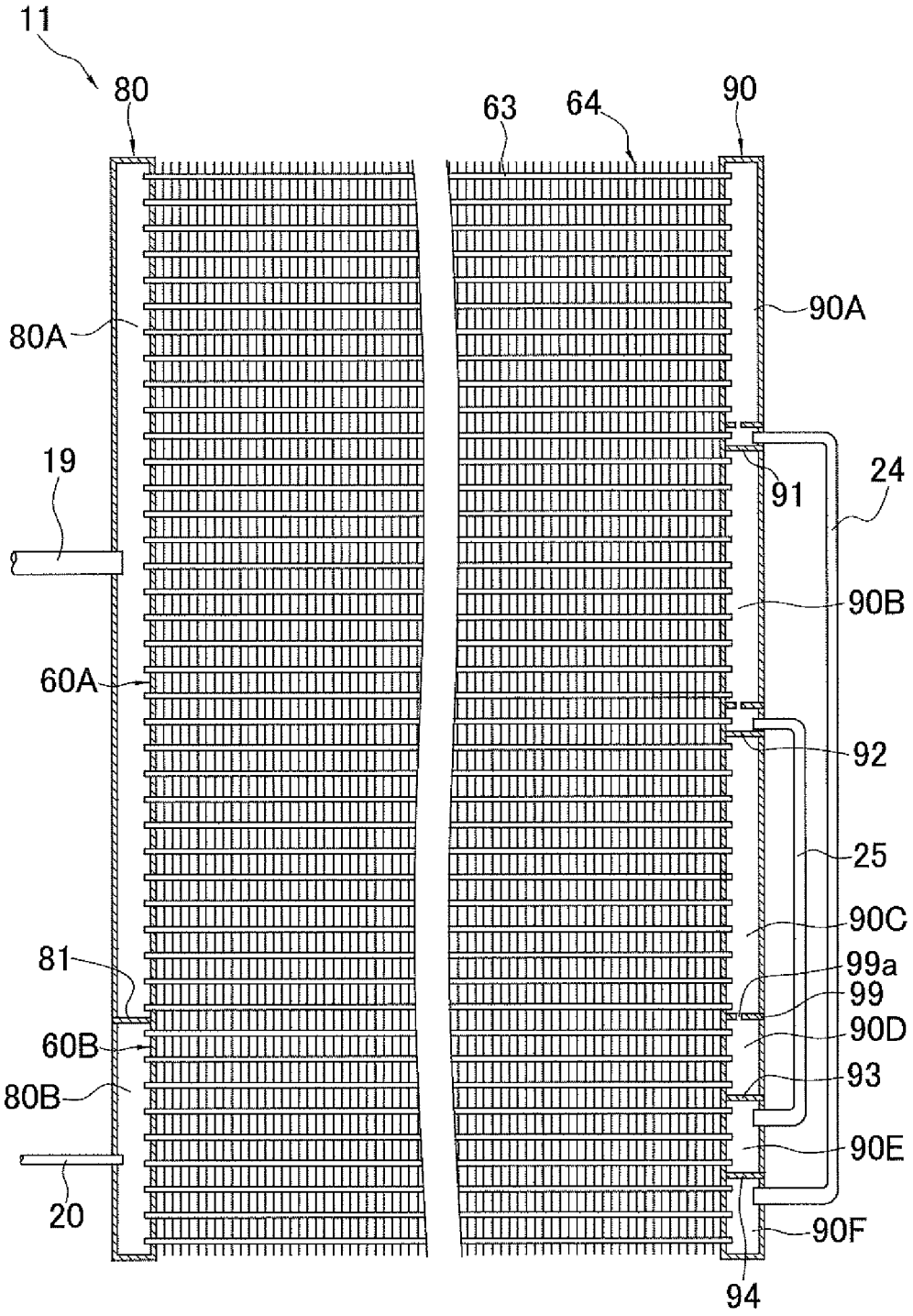
FIG. 7 is a configuration diagram for illustrating a refrigerant flow in the outdoor heat exchanger.

FIG. 2 is an external perspective view of the outdoor unit 2. FIG. 3 is a front view of the outdoor unit 2 (with the refrigerant circuit components other than the outdoor heat exchanger 11 removed). FIG. 4 is a schematic perspective view of the outdoor heat exchanger 11. FIG. 5 is a partially enlarged view of the heat exchange unit illustrated in FIG. 4. FIG. 6 is a schematic illustration of fins 64 attached to multiport flat tubes 63.

(3-1) Overall Configuration

The outdoor unit 2 is a top blowing heat exchange unit that sucks in air from the side surface of a casing 40 and blows out the air from the top surface of the casing 40. The outdoor unit 2 mainly includes the substantially rectangular parallelepiped casing 40, an outdoor fan 15 functioning as a fan, and refrigerant circuit components that constitute part of the refrigerant circuit 6. The refrigerant circuit components include the devices (7, 8, 11), such as a compressor and an outdoor heat exchanger, the valves (10, 12 to 14), such as a four-way switching valve and an outdoor expansion valve, and the refrigerant pipes (16 to 22). In the following description, the terms "upper", "lower", "left", "right", "front", "rear", "front surface", and "back surface" indicate directions of the outdoor unit 2 illustrated in FIG. 2 as view from the front (the front left side), unless otherwise specified.

The casing 40 mainly includes a bottom frame 42 extending between two mounting legs 41 each extending in the left-right direction, supports 43 each extending vertically from a corner of the bottom frame 42, a fan module 44 attached to the upper end of each of the supports 43, and a front panel 45. Air inlets 40*a*, 40*b*, and 40*c* are formed on the side surfaces (in this example, the back surface and the left and right side surfaces), and an air outlet 40*d* is formed on the top surface.

The bottom frame 42 forms the bottom surface of the casing 40, and the outdoor heat exchanger 11 is disposed on the bottom frame 42. In this example, the outdoor heat exchanger 11 is a heat exchanger having a substantially U-shape in plan view and facing the back surface and both left and right side surfaces of the casing 40. The outdoor heat exchanger 11 substantially forms the back surface and both left and right side surfaces of the casing 40.

A fan module 44 is disposed on the upper side with respect to the outdoor heat exchanger 11 and forms the front surface and the back surface of the casing 40, portions of both the left and right surfaces above the supports 43, and the top surface of the casing 40. Note that the fan module 44 is an assembly in which the outdoor fan 15 is accommodated in a substantially rectangular parallelepiped body with the upper and lower sides open. The opening of the top surface of the fan module 44 serves as the air outlet 40*d*, and the air outlet 40*d* is provided with an air outlet grill 46. The outdoor fan 15 is disposed in the casing 40 so as to face the air outlet 40*d*. The outdoor fan 15 is a fan that takes in air into the casing 40 through the air inlets 40*a*, 40*b*, and 40*c* and discharges the air through the air outlet 40*d*.

The front panel 45 extends between the supports 43 on the front surface side and forms the front surface of the casing 40.

The casing 40 further accommodates refrigerant circuit components other than the outdoor fan 15 and the outdoor heat exchanger 11 (the accumulator 7, the compressor 8, and the refrigerant pipes 16 to 18 are illustrated in FIG. 2). In this example, the compressor 8 and the accumulator 7 are disposed on the bottom frame 42.

As described above, the outdoor unit 2 includes the casing 40 having the air inlets 40*a*, 40*b*, and 40*c* formed on the side surfaces (in this example, the back surface and the left and right side surfaces) and the air outlet 40*d* formed on the top surface, the outdoor fan 15 disposed so as to face the air outlet 40*d* inside of the casing 40, and the outdoor heat exchanger 11 disposed below the outdoor fan 15 inside of the casing 40. Note that in such a top blowing unit configuration, the outdoor heat exchanger 11 is disposed under the outdoor fan 15. Accordingly, the wind speed of the air passing through the outdoor heat exchanger 11 tends to be higher in the upper portion of the outdoor heat exchanger 11 than in the lower portion of the outdoor heat exchanger 11 (refer to FIG. 3).

(3-2) Outdoor Heat Exchanger

The outdoor heat exchanger 11 is a heat exchanger that performs heat exchange between the refrigerant and outdoor air. The outdoor heat exchanger 11 mainly includes a first header collecting pipe 80, a second header collecting pipe 90, and a plurality of multiport flat tubes 63, and a plurality of fins 64. In this example, the first header collecting pipe 80, the second header collecting pipe 90, the multiport flat tube 63, and the fins 64 are all made of aluminum or an aluminum alloy and are mutually joined by brazing or the like.

Each of the first header collecting pipe 80 and the second header collecting pipe 90 is a vertically long hollow cylindrical member. The first header collecting pipe 80 is disposed at one end of the outdoor heat exchanger 11 (in this example, the left front end in FIG. 4) in a standing manner, and the second header collecting pipe 90 is disposed at the other end of the outdoor heat exchanger 11 (in this example, the right front end in FIG. 4) in a standing manner.

The multiport flat tube 63 is a multiport flat tube having flat surfaces 63*a* which are flat portions serving as heat transfer surfaces and facing in the vertical direction and having a large number of small passages 63*b* that enable the refrigerant to flow therethrough. The plurality of multiport flat tubes 63 are arranged in the up-down direction, and one end thereof is connected to the first header collecting pipe 80, and the other end is connected to the second header collecting pipe 90. The fins 64 divide a space between every adjacent two of the multiport flat tubes 63 into a plurality of air flow paths through which air flows. A plurality of horizontally extending elongated notches 64*a* are formed so that the plurality of multiport flat tubes 63 can be inserted thereinto. The shape of the notch 64*a* of the fin 64 is substantially the same as the contour of the sectional shape of the multiport flat tube 63.

The outdoor heat exchanger 11 includes a heat exchange unit 60 configured by fixing the fins 64 to a plurality of multiport flat tubes 63 arranged in the up-down direction. The heat exchange unit 60 includes an upper section heat exchange unit 60A in the upper section and a lower section heat exchange unit 60B in the lower section.

The internal space of the first header collecting pipe 80 is partitioned into upper and lower portions by a partition plate 81 extending in the horizontal direction. As a result, a gas-side inlet/outlet communication space 80A and a liquid-side inlet/outlet communication space 80B, which respectively correspond to the upper section heat exchange unit 60A and the lower section heat exchange unit 60B, are formed.

As used herein, the term "partitioning" is referred to as forming different refrigerant spaces by physically dividing the refrigerant. The term "partitioning" is distinguished from the term "dividing" in that there is no communication portion that enables direct communication between refrigerants.

In addition, the multiport flat tubes 63 constituting the corresponding upper section heat exchange unit 60A are in communication with the gas-side inlet/outlet communication space 80A. Furthermore, the multiport flat tubes 63 constituting the corresponding lower section heat exchange unit 60B are in communication with the liquid-side inlet/outlet communication space 80B.

Still furthermore, a refrigerant pipe 20 (refer to FIG. 1) is connected to the first header collecting pipe 80. The refrigerant pipe 20 delivers the refrigerant sent from the outdoor expansion valve 12 to the liquid-side inlet/outlet communication space 80B during a heating operation.

The inside of the second header collecting pipe 90 is partitioned into upper and lower portions by each of partition plates 91, 92, 93, and 94 that extend in the horizontal direction and is partitioned into upper and lower portions by a nozzle-equipped division plate 99. Thus, the following communication spaces are formed from the top in this order: a first upper section turned-back communication space 90A, a second upper section turned-back communication space 90B, a third upper section turned-back communication space 90C, a first lower section turned-back communication space 90D, a second lower section turned-back communication space 90E, and a third lower section turned-back communication space 90F. The first upper section turned-back communication space 90A, the second upper section turned-back communication space 90B, and the third upper section turned-back communication space 90C are in communication with the multiport flat tubes 63 in the corresponding upper section heat exchange unit 60A. The first lower section turned-back communication space 90D, the second lower section turned-back communication space 90E, and the third lower section turned-back communication space 90F are in communication with the multiport flat tubes 63 in the corresponding lower section heat exchange unit 60B. The third upper section turned-back communication space 90C and the first lower section turned-back communication space 90D are divided from each other in the up-down direction by the nozzle-equipped division plate 99. However, the third upper section turned-back communication space 90C and the first lower section turned-back communication space 90D communicate with each other in the up-down direction through a nozzle 99*a* provided in the nozzle-equipped division plate 99 that enables communication in the up-down direction. In addition, the first upper section turned-back communication space 90A is connected to the third lower section turned-back communication space 90F through a refrigerant connection pipe 24, and the second upper section turned-back communication space 90B is connected to the second lower section turned-back communication space 90E through a refrigerant connection pipe 25.

Through the above-described structure, when the outdoor heat exchanger 11 functions as an evaporator of the refrigerant, the refrigerant that has flowed from the refrigerant pipe 20 into the liquid-side inlet/outlet communication space 80B of the first header collecting pipe 80 flows in the multiport flat tubes 63 of the lower section heat exchange unit 60B connected to the liquid-side inlet/outlet communication space 80B. Thereafter, the refrigerant flows into the first lower section turned-back communication space 90D, the second lower section turned-back communication space 90E, and the third lower section turned-back communication space 90F of the second header collecting pipe 90. The refrigerant that has flowed into the first lower section turned-back communication space 90D flows into the third upper section turned-back communication space 90C through the nozzle 99*a* of the nozzle-equipped division plate 99 and flows into the gas-side inlet/outlet communication space 80A of the first header collecting pipe 80 via the multiport flat tubes 63 in the upper section heat exchange unit 60A connected to the third upper section turned-back communication space 90C. The refrigerant that has flowed into the second lower section turned-back communication space 90E flows into the second upper section turned-back communication space 90B via the refrigerant connection pipe 25 and flows into the gas-side inlet/outlet communication space 80A of the first header collecting pipe 80 via the multiport flat tubes 63 in the upper section heat exchange unit 60A connected to the second upper section turned-back communication space 90B. The refrigerant that has flowed into the third lower section turned-back communication space 90F flows into the first upper section turned-back communication space 90A via the refrigerant connection pipe 24 and flows into the gas-side inlet/outlet communication space 80A of the first header collecting pipe 80 via the multiport flat tubes 63 of the upper section heat exchange unit 60A connected to the first upper section turned-back communication space 90A. The refrigerants merged in the gas-side inlet/outlet communication space 80A of the first header collecting pipe 80 flow to the outside of the outdoor heat exchanger 11 via the refrigerant pipe 19. Note that when the outdoor heat exchanger 11 is used as a radiator of a refrigerant, the above-described flow of the refrigerant is reversed.

Figure 8:
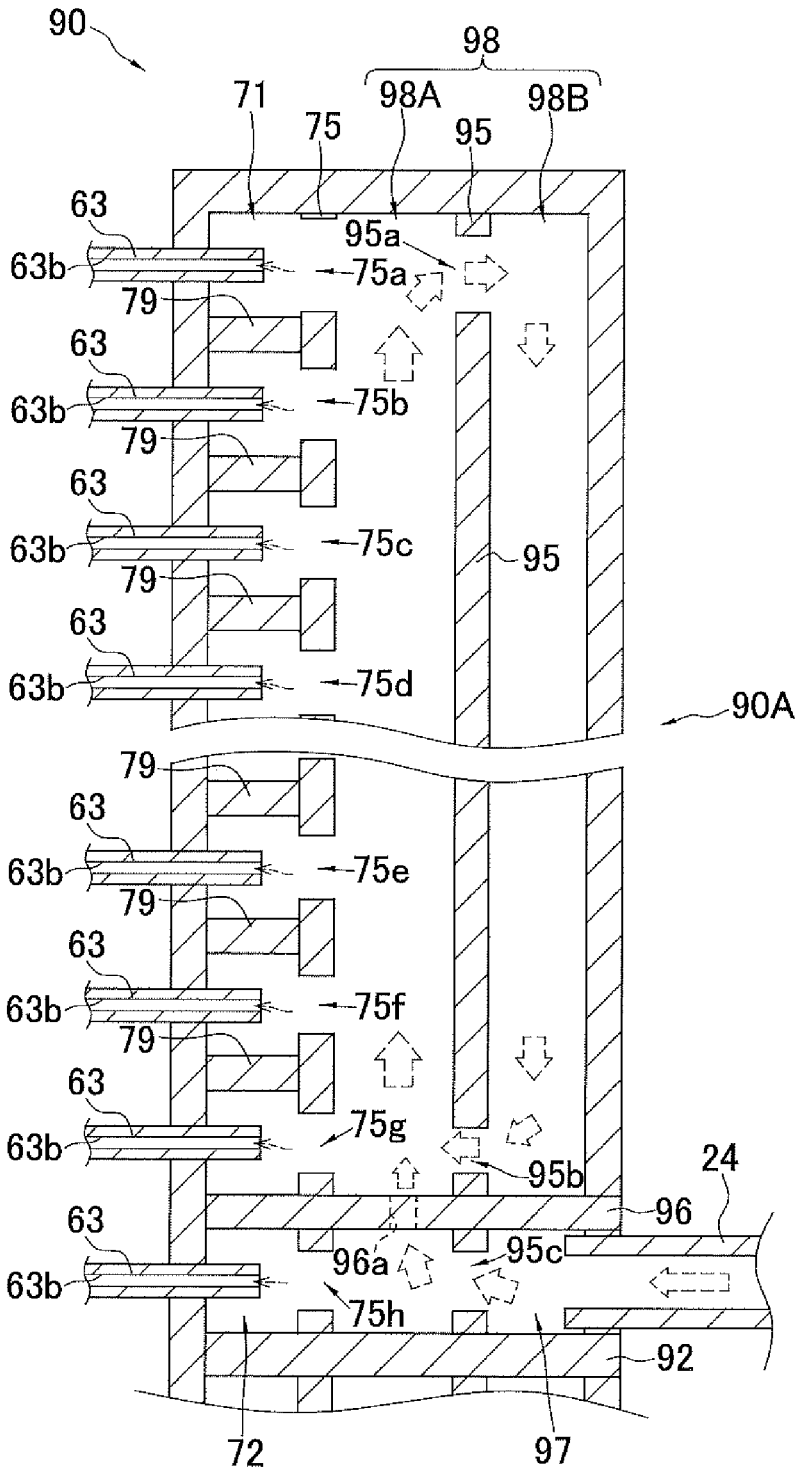
FIG. 8 is a schematic sectional configuration diagram of a portion in the vicinity of the top end of a second header collecting pipe of the outdoor heat exchanger, as viewed in the air flow direction.
Figure 9:
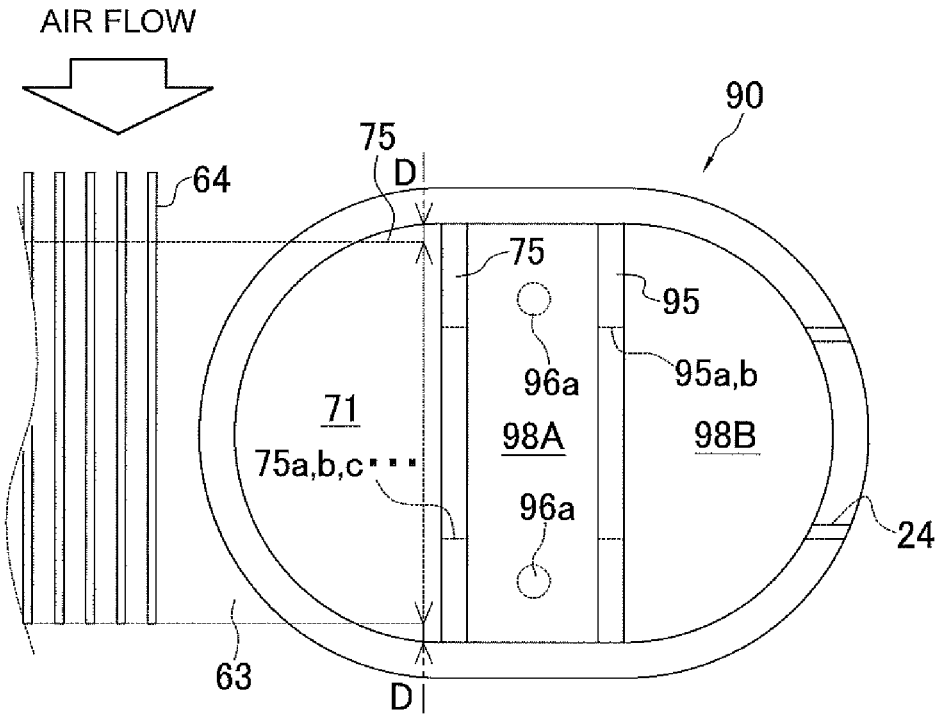
FIG. 9 is a schematic sectional configuration diagram of a portion in the vicinity of the top end of the second header collecting pipe of the outdoor heat exchanger, as viewed from above.

(4) Internal Structure of First Upper Section Turned-Back Communication Space 90A Etc FIG. 8 is a schematic sectional view of the structure of the first upper section turned-back communication space 90A of the second header collecting pipe 90 of the outdoor heat exchanger 11 as viewed in the air flow direction. FIG. 9 is a schematic sectional view of the structure of the first upper section turned-back communication space 90A of the second header collecting pipe 90 of the outdoor heat exchanger 11 as viewed from above.

The first upper section turned-back communication space 90A has, disposed therein, a nozzle-equipped division plate 96 which extends in the horizontal direction and has a nozzle 96*a* formed therein, an insertion division plate 75 which extends in the up-down direction and in the air passage direction, and a circulation division plate 95 (corresponding to a circulation member or a circulation division member) which extends in the up-down direction and in the air passage direction and which extends parallel to the insertion division plate 75.

The nozzle-equipped division plate 96 divides the first upper section turned-back communication space 90A in the up-down direction into an insertion space 71 and a circulation space 98 located on the upper side and an insertion space 72 and an introduction space 97 located on the lower side.

The insertion division plate 75 extends in the up-down direction and in the air passage direction in the first upper section turned-back communication space 90A so as to divide the first upper section turned-back communication space 90A into the insertion space 71 to which the multiport flat tubes 63 are connected and the circulation space 98 located on the side opposite to the connection side of the multiport flat tubes 63 (an opposite-connection side). Note that the insertion division plate 75 similarly divides each of the second upper section turned-back communication space 90B and the third upper section turned-back communication space 90C into the insertion space 71 and the circulation space 98. That is, the insertion division plate 75 is formed as a plate-like member which continuously extends in the up-down direction in the first upper section turned-back communication space 90A, the second upper section turned-back communication space 90B, and the third upper section turned-back communication space 90C.

Flow dividing openings 75*a* to 75*h* are formed in the insertion division plate 75, which pass through the insertion division plate 75 in the plate thickness direction at the height positions each facing one of the multiport flat tubes 63. The opening areas of the flow dividing openings 75*a* to 75*h* gradually increase from the above-described lower section of the outdoor heat exchanger 11 toward the upper section of the outdoor heat exchanger 11 in order to prevent the wind speeds from increasing toward the upper section. In this manner, the flow rate of the refrigerant sent to each of the multiport flat tubes 63 is made to match the wind speed of the air flow with which heat exchange is performed and, thus, the difference among the states of the refrigerants flowing through the multiport flat tubes 63 is reduced. As a result, the heat exchange performance can be improved.

Note that since in general, the liquid refrigerant is susceptible to the influence of gravity, most of the liquid refrigerant flows in the relatively lower region. Consequently, the amount of the liquid refrigerant tends to be insufficient in the upper region. In contrast, in this example, the structure is such that the opening areas of the flow dividing openings gradually decrease from the upper side toward the lower side. In this manner, the opening areas of the flow dividing openings are small in the lower region in which the liquid refrigerant tends to remain, and the opening areas of the flow dividing openings are large in the upper region in which the amount of the liquid refrigerant tends to be insufficient. As a result, the drift of the liquid refrigerant in the direction of gravity can be reduced.

Note that the structure is such that the front end of the multiport flat tube 63 connected to the second header collecting pipe 90 is not located on the opposite-connection side of the insertion division plate 75.

In addition, between every adjacent two of the multiport flat tubes 63 arranged in the up-down direction, a flow dividing plate 79 is provided so as to extend in the horizontal direction (parallel to the upper and lower flat surfaces 63*a* of the multiport flat tube 63) between the inner peripheral surface of the second header collecting pipe 90 on the side to which the multiport flat tubes 63 are connected and the insertion division plate 75. In the insertion space 71, since the flow dividing plate 79 extends between every adjacent two of the multiport flat tubes 63, each of the refrigerants divided by the flow dividing openings 75*a* to 75*h* can be directly led into the corresponding one of the multiport flat tubes 63.

Note that as illustrated in FIG. 9, the portion of the second header collecting pipe 90 to which the multiport flat tube 63 is connected has a shape of a circular arc that is convex in the direction in which the multiport flat tube 63 extends. Consequently, the pressure resistance strength can be increased. In this case, a gap D is easily formed in the air flow direction between the circular arc-shaped inner peripheral surface of the second header collecting pipe 90 and the insertion end of the multiport flat tube 63 due to the design. Even when the gap D is formed, expansion of the refrigerant flow path in the circulation space 98 can be prevented, since the flow dividing plates 79 are provided above and below the gap D, and the insertion division plate 75 is also provided.

Note that a space below the nozzle-equipped division plate 96 is divided into the insertion space 72 to which the multiport flat tube 63 is connected and the introduction space 97 to which the refrigerant connection pipe 24 is connected by the insertion division plate 75.

In part of the first upper section turned-back communication space 90A above the nozzle-equipped division plate 96, the circulation division plate 95 extends parallel to the insertion division plate 75 in the up-down direction and in the air passage direction on the opposite-connection side of the insertion division plate 75. Thus, the circulation division plate 95 divides the circulation space 98 into a rising space 98A that causes the refrigerant to move upward when the evaporator is used and a falling space 98B that causes the refrigerant to move downward when the evaporator is used. Note that in the same manner, the circulation division plate 95 divides each of the second upper section turned-back communication space 90B and the third upper section turned-back communication space 90C into the rising space 98A and the falling space 98B. That is, the circulation division plate 95 is configured by a plate-like member that continuously extends in the up-down direction in the first upper section turned-back communication space 90A, the second upper section turned-back communication space 90B, and the third upper section turned-back communication space 90C.

Note that the nozzle 96*a* of the nozzle-equipped division plate 96 is provided at a position so as to communicate with the rising space 98A. In plan view, the nozzle 96*a* does not overlap with the flow dividing plate 79 and the insertion division plate 75.

In the circulation space 98 inside of the first upper section turned-back communication space 90A, the circulation division plate 95 is provided with an upper communication port 95*a* that passes therethrough in the thickness direction in the upper section of the circulation space 98 and a lower communication port 95*b* that passes therethrough in the thickness direction in the lower section of the circulation space 98. In addition, in the introduction space 97 below the nozzle-equipped division plate 96 inside of the first upper section turned-back communication space 90A, the circulation division plate 95 is provided with a connection port 95*c* that passes therethrough in the thickness direction. Similarly, in the second upper section turned-back communication space 90B, the circulation division plate 95 is provided with the upper communication port 95*a*, the lower communication port 95*b*, and the connection port 95*c*. In the third upper section turned-back communication space 90C, the circulation division plate 95 is provided with the upper communication port 95*a* and the lower communication port 95*b*.

(5) Flow of Refrigerant in First Upper Section Turned-Back Communication Space 90A The flow of the refrigerant in the first upper section turned-back communication space 90A of the above-described structure when the outdoor heat exchanger 11 is used as an evaporator of the refrigerant is described below.

Part of the refrigerant that has flowed into the introduction space 97 under the nozzle-equipped division plate 96 through the refrigerant connection pipe 24 moves to the lower portion of the rising space 98A. Thereafter, the refrigerant is blown up in the rising space 98A through the nozzle 96*a* of the nozzle-equipped division plate 96, and the remaining refrigerant is led to the insertion space 72 below the nozzle-equipped division plate 96 via the flow dividing opening 75*h* of the insertion division plate 75 so as to flow into the multiport flat tube 63.

The refrigerant sent into the rising space 98A moves upward in the rising space 98A. Thereafter, the flow of the refrigerant is divided into the flow dividing openings 75*a* to 75*h* of the insertion division plate 75. The refrigerant that has reached a portion in the vicinity of the top end of the rising space 98A is sent into the falling space 98B via the upper communication port 95*a* of the circulation division plate 95. Subsequently, the refrigerant moves downward in the falling space 98B.

The refrigerant that has moved downward in the falling space 98B is again led to the rising space 98A through the lower communication port 95*b* of the circulation division plate 95 at a portion in the vicinity of the lower end of the falling space 98B. In this manner, the refrigerant circulates in the circulation space 98.

Note that since the refrigerant in the rising space 98A branches at the flow dividing openings 75*a* to 75*g* of the insertion division plate 75, the refrigerant branches at the heights of the insertion spaces 71, and each of the branched refrigerants flows out through one of the multiport flat tubes 63 connected at the corresponding height.

Note that the structure and the flow of the refrigerant in the second upper section turned-back communication space 90B are the same as the structure and the flow of the refrigerant in the first upper section turned-back communication space 90A. Accordingly, description of the structure and the flow of the refrigerant is not repeated.

In addition, the structure and the flow of refrigerant in the third upper section turned-back communication space 90C differ from those in the first upper section turned-back communication space 90A in that the nozzle-equipped division plate 96 in the first upper section turned-back communication space 90A corresponds to the nozzle-equipped division plate 99 that forms the lower end of the third upper section turned-back communication space 90C. However, the other structures and the flow of refrigerant are the same as those in the first upper section turned-back communication space 90A. Accordingly, description of the structure and the flow of the refrigerant is not repeated.

(6) Features 6-1

According to the outdoor heat exchanger 11 of one or more embodiments, an insertion space 71 divided by the insertion division plate 75 and the flow dividing plate 79 is formed in the second header collecting pipe 90. Therefore, in the case of manufacturing the outdoor heat exchanger 11 by connecting the plurality of multiport flat tubes 63 to the second header collecting pipe 90, even when a manufacturing error occur in the degree or length of insertion of the multiport flat tube 63 into the second header collecting pipe 90, the flow path area of the rising space 98A can be set to the intended size, as long as the front end of each of the multiport flat tubes 63 is positioned in the insertion space 71 (the distance between the insertion division plate 75 and the circulation division plate 95 can be directly maintained as the flow path area).

6-2

By dividing the inside of the second header collecting pipe 90 of the outdoor heat exchanger 11 according to one or more embodiments into the rising space 98A, the falling space 98B, and the insertion space 71 in plan view, the refrigerant passage area of the rising space 98A can be sufficiently reduced.

As a result, in the case where the outdoor heat exchanger 11 is used as an evaporator of the refrigerant, even when the refrigerant circulation amount is small, the refrigerant blown out upward from the nozzle 96*a* can be sufficiently supplied to even the multiport flat tube 63 connected at a higher position.

In addition, the refrigerant can be circulated in the circulation space 98 by providing the upper communication port 95*a* and the lower communication port 95*b* in the circulation division plate 95. Thus, in the case where the outdoor heat exchanger 11 is used as an evaporator of the refrigerant, even when the refrigerant circulation amount increases, the refrigerant that tends to gather in the upper section of the rising space 98A without being branched into the multiport flat tubes 63 at lower positions can be returned to the rising space 98A via the falling space 98B again. As a result, the refrigerant can be sufficiently supplied to even the multiport flat tubes 63 at the lower positions.

6-3

If neither the insertion division plate 75 nor the flow dividing plate 79 is provided in the second header collecting pipe 90 of the outdoor heat exchanger 11 according to one or more embodiments, the rising space 98A is expanded toward the multiport flat tubes 63. Thus, the upward flow of the refrigerant passes through the gap D illustrated in FIG. 9 (the gap between the front end of the multiport flat tube 63 and the inner peripheral surface of the second header collecting pipe 90) upward. If the space for raising the refrigerant expands in this manner, the flow velocity of the refrigerant moving upward tends to decrease and, thus, a sufficient amount of refrigerant is not likely to be supplied to the multiport flat tube 63 connected in the vicinity of the upper end.

In contrast, the insertion division plate 75 and the flow dividing plate 79 are provided in the second header collecting pipe 90 of the outdoor heat exchanger 11 according to one or more embodiments. Accordingly, the gap D between the front end of the multiport flat tube 63 and the inner peripheral surface of the second header collecting pipe 90 can be disposed in the insertion space 71 and, thus, can be disposed away from the rising space 98A. As a result, the refrigerant flow path area of the rising space 98A can be reduced so that the refrigerant can easily reach the higher position.

6-4

According to of the outdoor heat exchanger 11 of one or more embodiments, in the second header collecting pipe 90, the insertion space 71 is divided from the rising space 98A by the insertion division plate 75. In addition, the insertion space 71 can be divided into an upper section and the lower section by the flow dividing plate 79. For this reason, mixing of the refrigerants which are divided at the flow dividing openings 75*a* to 75*h* of the insertion division plate 75 before being led to the corresponding multiport flat tubes 63 can be prevented and, thus, the dividing performance can be improved.

6-5

According to the outdoor heat exchanger 11 of one or more embodiments, the nozzle 96*a* of the nozzle-equipped division plate 96 is located so as not to overlap with the flow dividing plate 79 and the insertion division plate 75 in plan view. For this reason, the upward flow of the refrigerant that has passed through the nozzle 96*a* is not weakened by collision with the flow dividing plate 79 or the insertion division plate 75 during the upward movement. In addition, the upward flow of the refrigerant that has passed through the nozzle 96*a* is likely to be led upward along the insertion division plate 75 that extends in the up-down direction.

In this manner, the refrigerant can be reliably supplied at a higher position.

6-6

Since the outdoor unit 2 according to one or more embodiments is of a so-called top blow-out type in which the blowing direction of the outdoor fan 15 provided above the outdoor heat exchanger 11 is the upward direction, the wind speed in the upper portion of the outdoor heat exchanger 11 tends to be higher than in the lower portion of the outdoor heat exchanger 11.

In contrast, the outdoor heat exchanger 11 according to one or more embodiments is configured such that among the flow dividing opening 75*a* to 75*h* formed in the insertion division plate 75, the flow dividing opening located at a higher position has a larger opening area.

For this reason, the flow rate of the refrigerant sent to each of the multiport flat tubes 63 is made to match the wind speed of the air flow with which heat exchange is to be performed, so that the difference among the states of the refrigerants in the multiport flat tubes 63 located at different height positions is reduced. In this manner, the heat exchange performance can be improved.

(7) Modifications

While examples of the embodiments have been described above, the present invention is not limited to the above-described embodiments. Various modifications may be made to the embodiments described above without departing from the scope of the present invention.

(7-1) Modification A

The above embodiments have been described with reference to the case where the nozzle 96*a* of the nozzle-equipped division plate 96 is located below the rising space 98A and, thus, the insertion space 71 and the rising space 98A are adjacent to each other.

However, the nozzle 96*a* of the nozzle-equipped division plate 96 may be located below the space on the opposite side of the circulation division plate 95 from the insertion space 71 and, thus, the insertion space 71 and a space in which the refrigerant moves downward may be adjacent to each other.

In this case, the flow of the refrigerant moves downward in the falling space 98B and is branched at the flow dividing openings 75*a* to 75*h* of the insertion division plate 75.

(7-2) Modification B

The above embodiments have been described with reference to an example of the structure in which the insertion space 71 is formed by providing both the insertion division plate 75 and the plurality of flow dividing plates 79, and the front ends of the multiport flat tubes 63 connected to the second header collecting pipe 90 are located on the side of the insertion division plate 75 adjacent to the multiport flat tubes 63.

However, the insertion space 71 may be formed as the structure in which one of the insertion division plate 75 and the plurality of flow dividing plates 79 is not provided.

Like the above-described embodiments, in the structure in which the plurality of flow dividing plates 79 are not provided, the side of the insertion division plate 75 on which the multiport flat tubes 63 are connected functions as the insertion space 71. In this case, although there is a risk that some of the refrigerants branched by the flow dividing openings 75*a* to 75*h* of the insertion division plate 75 are mixed before being led to the corresponding multiport flat tubes 63, an error in positioning of the connection destination points of the multiport flat tubes 63 at the time of manufacture can be prevented.

In addition, in the structure in which the insertion division plate 75 is not provided and the plurality of flow dividing plates 79 form the insertion space 71, the insertion space 71 is formed as a space between the flow dividing plates 79 in the up-down direction. Even in this case, a structure is employed in which the front ends of the multiport flat tubes 63 connected to the second header collecting pipe 90 are located closer to the multiport flat tube 63 than the opposite-connection side end of the flow dividing plate 79. Thus, an error in positioning of the connection destination points of the multiport flat tubes 63 at the time of manufacture can be prevented.

(7-3) Modification C

Modification B has been described above with reference to an example of the structure in which even when the insertion division plate 75 is not provided in the above-described embodiments, the end portion of each of the flow dividing plates 79 remote from the multiport flat tube 63 is located farther away from the multiport flat tube 63 than the insertion end of the multiport flat tube 63 and, thus, an error in positioning of the connection destination points of the multiport flat tube 63 at the time of manufacture can be prevented.

Figure 10:
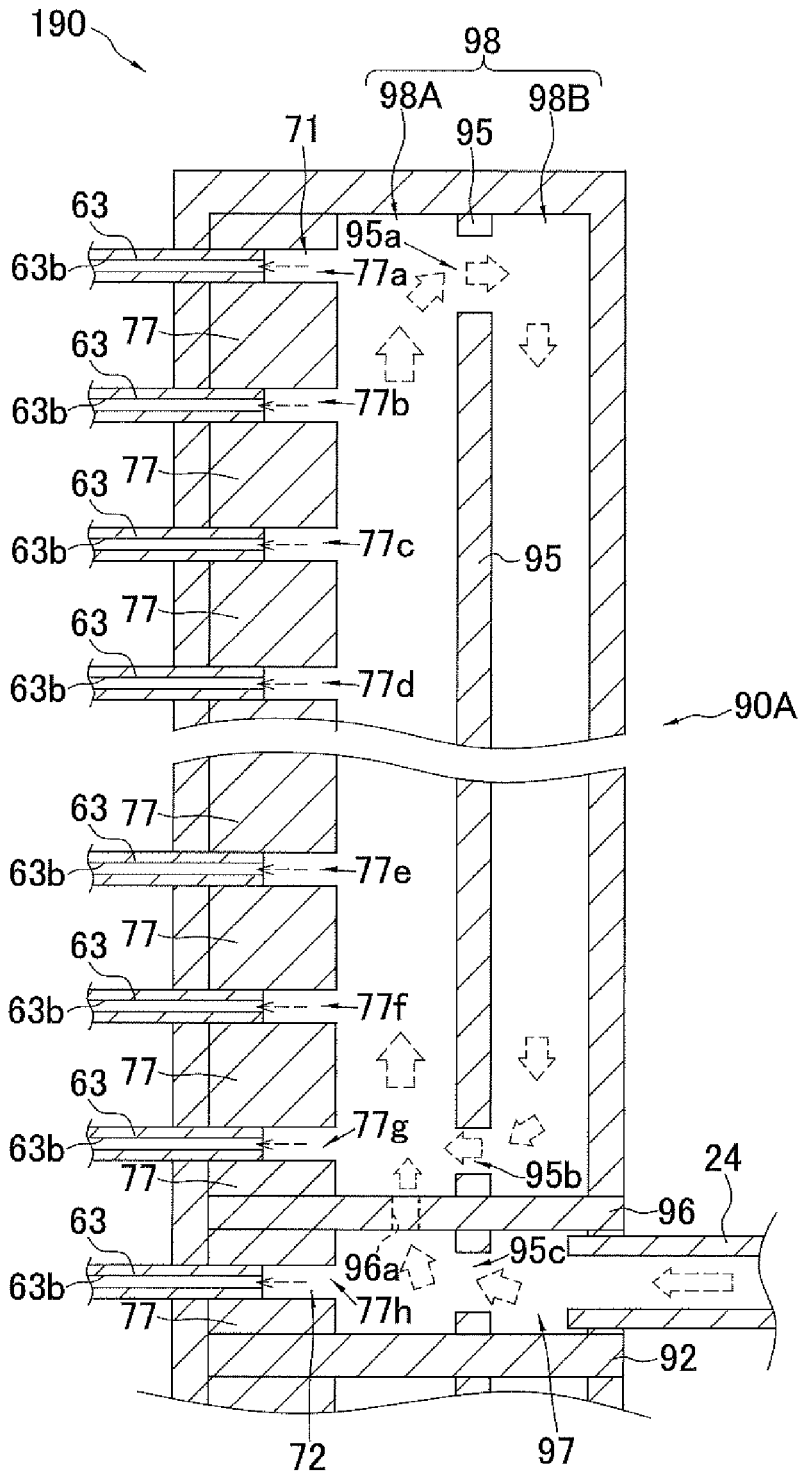
FIG. 10 is a schematic sectional configuration diagram of the header collecting pipe according to modification C, as viewed in the air flow direction.

In contrast, for example, a header collecting pipe 190 illustrated in FIG. 10 may be employed to prevent an error in the connection destination points of the multiport flat tube 63 at the time of manufacture. As illustrated in the schematic sectional view of the header collecting pipe 190 of FIG. 10 as viewed in the air flow direction, the header collecting pipe 190 uses a plurality of dividing members 77 instead of using the insertion division plate 75 and the plurality of flow dividing plates 79 according to the above-described embodiments.

More specifically, the schematic structure of the header collecting pipe 190 is substantially the same as each of the structures illustrated in FIG. 8 according to the above-described embodiments. However, in the header collecting pipe 190, the plurality of dividing members 77 form the insertion spaces 71. In addition, the dividing members 77 divide the insertion spaces 71 from the circulation space 98 (for example, the rising space 98A).

The dividing members 77 are provided such that spaces above and under each of the multiport flat tubes 63 and the space in front of the multiport flat tube 63 in the insertion direction of the multiport flat tube 63 (the space in which the multiport flat tube 63 passes when the multiport flat tube 63 is moved in the longitudinal direction) are filled therewith. More specifically, the dividing members 77 are disposed such that the space between every adjacent two of the multiport flat tubes 63 arranged in the up-down direction, that is, the space between the upper flat surface of the lower multiport flat tube 63 and the lower flat surface of the upper multiport flat tube 63 is filled with one of the dividing members 77. In addition, each of the dividing members 77 is provided such that an end portion thereof is positioned closer to the circulation division plate 95 than the multiport flat tube 63. The positions of the end portions of the dividing members 77 adjacent to the circulation division plate 95 are all the same, and the end portions of the dividing members 77 adjacent to the circulation division plate 95 face the circulation division plates 95 and extend in parallel.

This structure enables the space that is formed between the dividing members 77 and that is not filled with the multiport flat tube 63 to function as the insertion space 71 described in the above-described embodiments. That is, even if a difference in degree of insertion occurs when the multiport flat tubes 63 are inserted into the header collecting pipe 190 and, thus, an error in the position of the front end of the multiport flat tube 63 occurs, the error can be absorbed by each of the insertion spaces 71 surrounded by the plurality of dividing members 77. In this manner, even when an error occurs in the position of the front end of each of the multiport flat tubes 63, the intended refrigerant passage area of the circulation space 98 (for example, the rising space 98A) can be easily maintained (that is, the passage cross-sectional area of the space that is formed between an end surface of each of the dividing members 77 adjacent to the circulation division plate 95 and a surface of the circulation division plate 95 facing the end surface and that enables the refrigerant to pass therethrough).

(7-4) Modification D

The above embodiments have been described with reference to an example of the outdoor heat exchanger 11 provided in a standing manner so that the first header collecting pipe 80 and the second header collecting pipe 90 extend in the vertical direction.

In contrast, the orientation of each of the header collecting pipes is not limited thereto. For example, an outdoor heat exchanger used with the orientation in which the longitudinal direction of each of the multiport flat tubes is the horizontal direction may be employed. Even in this case, like the above-described embodiments, the influence of the error in the position of the front end of the multiport flat tube 63 can be minimized.

(7-5) Modification E

The above embodiments have been described with reference to the multiport flat tube 63 serving as a heat transfer tube connected to the first header collecting pipe 80 and the second header collecting pipe 90 as an example.

However, the heat transfer tube connected to the first header collecting pipe 80 and the second header collecting pipe 90 is not limited to a flat heat transfer tube. In addition, the heat transfer tube connected to the first header collecting pipe 80 and the second header collecting pipe 90 is not limited to a multiport heat transfer tube including a plurality of refrigerant passages.

For example, the heat transfer tube connected to the first header collecting pipe 80 and the second header collecting pipe 90 may be a cylindrical heat transfer tube. Even in this case, like the above-described embodiments, the influence of the error in the position of the front end of a cylindrical heat transfer tube can be minimized.

(7-6) Modification F

The above embodiments have been described with reference to the structure in which the second header collecting pipe 90 having a substantially cylindrical shape as an example.

Figure 11:
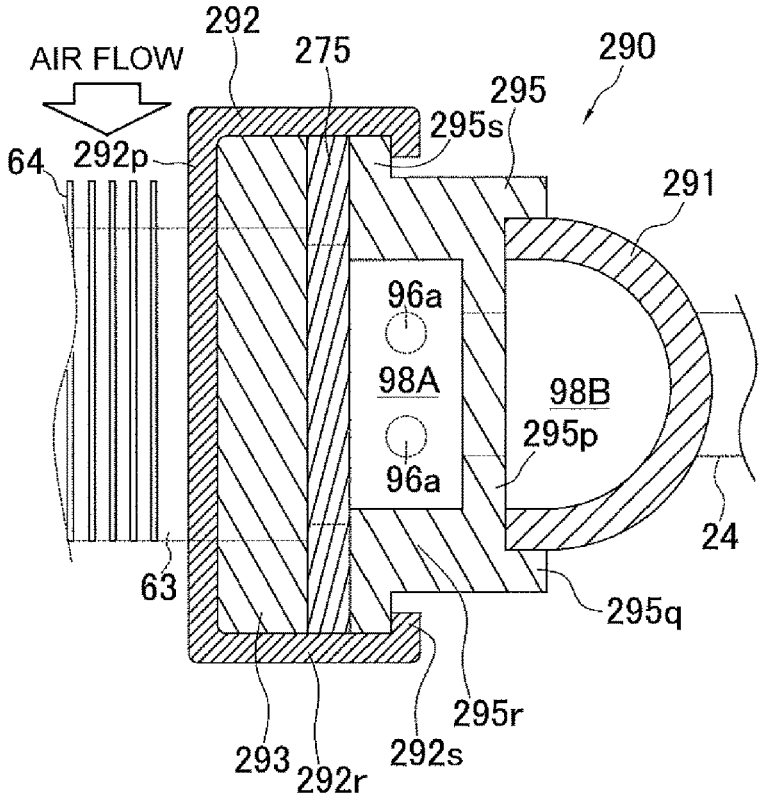
FIG. 11 is a schematic sectional configuration diagram of the header collecting pipe according to modification F located at a height at which a multiport flat tube is not located, as viewed from above.
Figure 12:
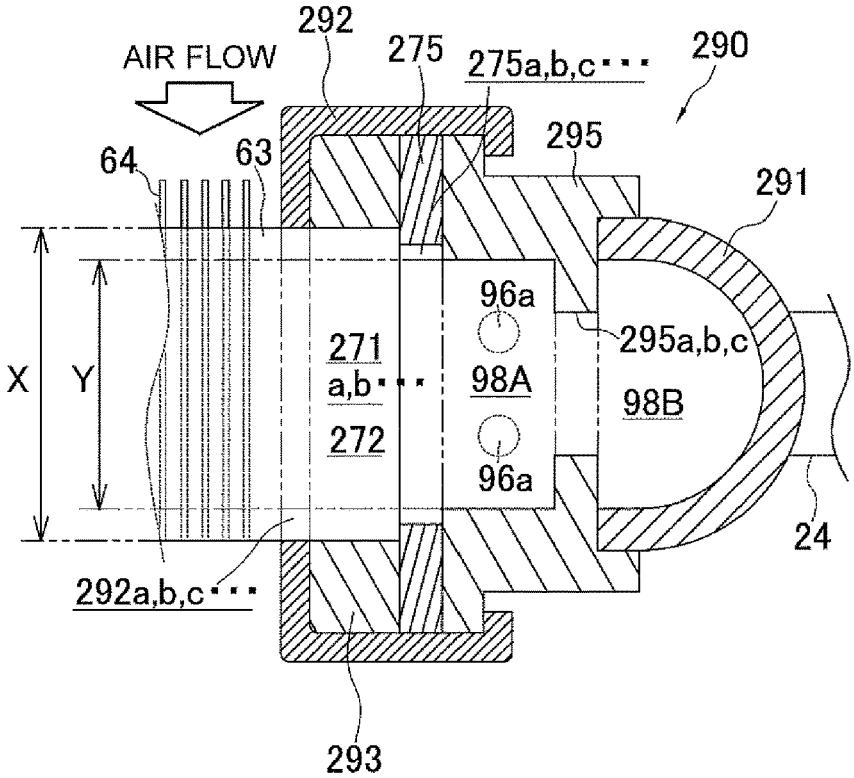
FIG. 12 is a schematic sectional configuration diagram of the header collecting pipe according to modification F located at a height at which a multiport flat tube is located, as viewed from above.
Figure 13:
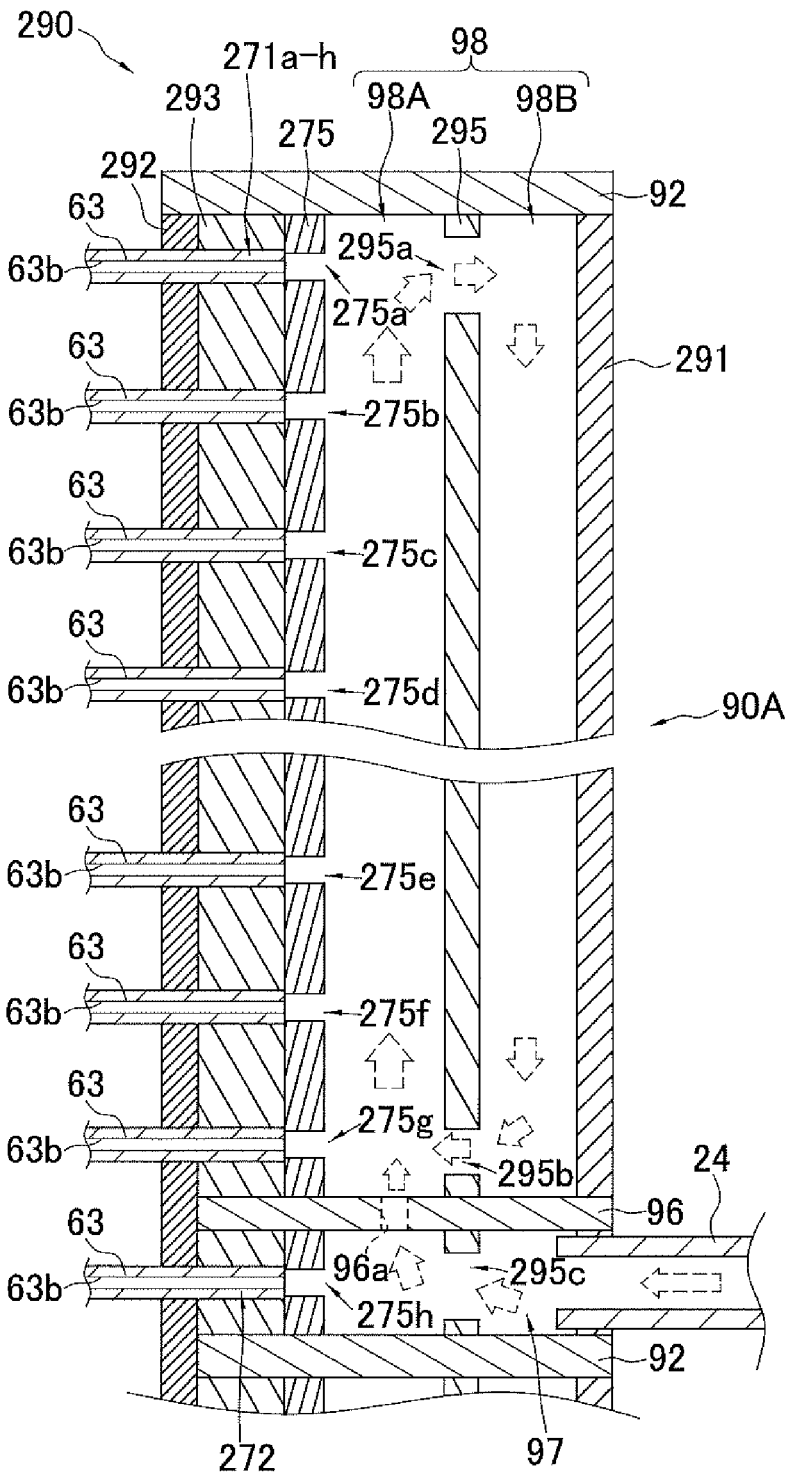
FIG. 13 is a schematic sectional configuration diagram of the header collecting pipe according to modification F, as viewed in the air flow direction.

In contrast, as illustrated in FIG. 11, FIG. 12, and FIG. 13, a second header collecting pipe 290 having a non-cylindrical shape formed by a plurality of members may be employed as the second header collecting pipe 90.

The second header collecting pipe 290 mainly includes a rising division member 295, a falling space forming member (i.e., "longitudinal shell") 291, a regulating plate member 275, an insertion plate member 293, a caulking member 292, a partition plate 92, and a nozzle-equipped division plate 96.

The rising division member 295 includes circulation division portions 295*p*, clamping portions 295*q*, rising space forming portions 295*r*, and locking protrusions 295*s*, which all extend in the up-down direction. The circulation division portion 295*p* is a plate-like portion that extends in the air flow direction and the up-down direction between the rising space 98A and the falling space 98B. The circulation division portion 295*p* divides the rising space 98A from the falling space 98B. Note that, the circulation division portion 295*p* includes an upper communication port 295*a* that passes through the upper portion thereof in the thickness direction (the direction in which the multiport flat tube 63 is inserted) and a lower communication port 295*b* that passes through the lower portion thereof in the thickness direction (the direction in which the multiport flat tube 63 is inserted). The clamping portions 295*q* are portions protruding from either end in the air flow direction of the circulation division portion 295*p* toward a direction away from a point at which the multiport flat tube 63 is connected. The circulation division portions 295*p* clamp both the sides of the falling space forming member 291 in the air flow direction. The rising space forming portions 295*r* are portions extending from the circulation division portions 295*p* toward the multiport flat tubes 63. The rising space forming portions 295*r* form both side surfaces in the air flow direction of the rising space 98A. The locking protrusions 295*s* are protrusions protruding from the side surfaces in the air flow direction of the end portions of the rising space forming portions 295*r* adjacent to the multiport flat tubes 63 in a direction in which the locking protrusion 295*s* are away from each other. The locking protrusions 295*s* are caulked by the caulking member 292 described below.

The falling space forming member 291 is a semicircular column member extending is the up-down direction which is the longitudinal direction thereof. The falling space forming member 291 is welded to the rising division member 295 such that the inner peripheral surface thereof faces the circulation division portion 295*p* of the rising division member 295 and both ends thereof in the air flow direction are clamped by the clamping portions 295*q* of the rising division member 295. In this manner, the falling space 98B extending in the up-down direction is formed between the falling space forming member 291 and the rising division member 295. As described above, the falling space 98B can be simply formed by using the rising division member 295 in combination with the falling space forming member 291, which is a separate member, as a member for forming the falling space 98B. Note that according to modification F, the width in the air flow direction of the rising space 98A and the width in the air flow direction of the falling space 98B are set to the same value.

Figure 14:
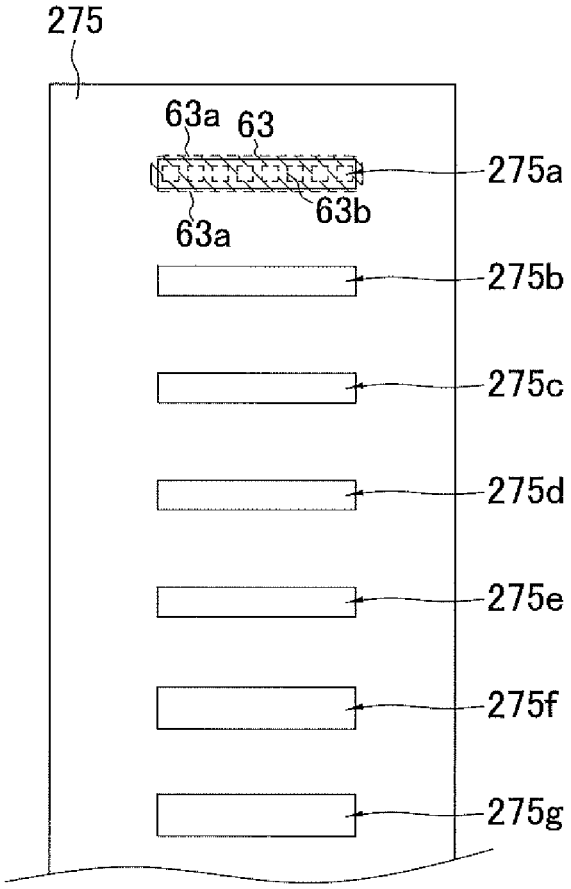
FIG. 14 is a schematic configuration diagram of a regulating plate member in the header collecting pipe according to modification F, as viewed in the thickness direction of the regulating plate member.

The regulating plate member 275 is a plate-like member that is disposed closer to the multiport flat tube 63 than the rising division member 295 and that extends perpendicularly to the insertion direction of the multiport flat tubes 63 (extends in the air flow direction and the up-down direction). As illustrated in FIG. 14, the regulating plate member 275 is provided with connection spaces 275*a* to 275*g* that are arranged in the up-down direction and that correspond to the multiport flat tubes 63 in a one-to-one manner, as viewed in the insertion direction of the multiport flat tubes 63. Each of the connection spaces 275*a* to 275*g* is a space formed by penetrating the regulating plate member 275 in the thickness direction. Each of the connection spaces 275*a* to 275*g* has a shape in the longitudinal direction that matches the flat sectional shape of the multiport flat tube 63 and has a shape and a size so that the multiport flat tube 63 is not allowed to pass therethrough. More specifically, as indicated by the sectional shape of the multiport flat tube 63 denoted by a dotted line (in only the uppermost section) in FIG. 14, the contour of each of the connection spaces 275*a* to 275*g* is located between the upper and lower flat surfaces 63*a* and is located inside of both ends of the multiport flat tubes 63 in the air flow direction. In addition, each of the plurality of passages 63*b* of the multiport flat tube 63 is configured to be located inside the contour of a corresponding one of the connection spaces 275*a* to 275*g*. Note that according to one or more embodiments, the upstream-side end and the downstream-side end in the air flow direction of each of the connection spaces 275*a* to 275*g* of the regulating plate member 275 are located outside of the upstream-side end and the downstream-side end in the air flow direction of the rising space 98A, respectively. Note that the width in the air flow direction of the regulating plate member 275 and the width in the air flow direction of each of the locking protrusions 295*s* of the rising division member 295 are set to the same value.

Figure 15:
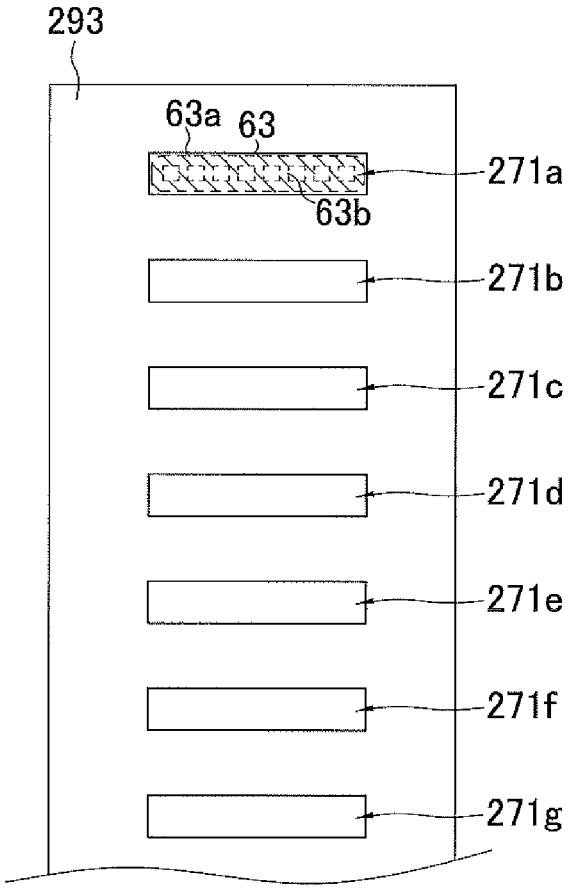
FIG. 15 is a schematic configuration diagram of an insertion plate member in the header collecting pipe according to modification F, as viewed in the thickness direction of the insertion plate member.

The insertion plate member 293 is a plate-like member that is disposed closer to the multiport flat tubes 63 than the regulating plate member 275 and that extends parallel to the regulating plate member 275. As illustrated in FIG. 15, like the regulating plate member 275, the insertion plate member 293 is provided with insertion spaces 271*a* to 271*g* that are arranged in the up-down direction and that correspond to the multiport flat tubes 63 in a one-to-one manner, as viewed in the insertion direction of the multiport flat tubes 63, as viewed in the insertion direction of the multiport flat tube 63. Each of the insertion spaces 271*a* to 271*g* is a space formed by penetrating the insertion plate member 293 in the thickness direction. Each of the insertion spaces 271*a* to 271*g* has a shape in the longitudinal direction that matches the flat sectional shape of the multiport flat tube 63 and has a shape and a size so that the multiport flat tube 63 is allowed to pass therethrough. More specifically, as indicated by the sectional shape of the multiport flat tube 63 denoted by a dotted line (in only the uppermost section) in FIG. 15, the contour of each of the insertion spaces 271*a* to 271*g* is located above the upper flat surface 63*a* or below the lower flat surface 63*a* and is located outside of both ends of the multiport flat tube 63 in the air flow direction. Thus, the peripheral surface of the multiport flat tube 63 is blazed and fixed to the inner peripheral surface of the corresponding one of the insertion spaces 271*a* to 271*g* of the insertion plate member 293. Note that according to one or more embodiments, the upstream-side end and the downstream-side end in the air flow direction of each of the insertion spaces 271*a* to 271*g* of the insertion plate member 293 are located outside of the upstream-side end and the downstream-side end in the air flow direction of the rising space 98A, respectively, and outside of the upstream-side end and the downstream end in the air flow direction of the corresponding one of the connection spaces 275*a* to 275*g* of the regulating plate member 275, respectively (as illustrated in FIG. 12, a distance X between the upstream-side end and the downstream-side end in the air flow direction of each of the insertion spaces 271*a* to 271*g* of the insertion plate member 293 (the distance X is substantially the same as the width of the multiport flat tube 63 in the air flow direction) is greater than a distance Y between the upstream-side end and the downstream-side end in the air flow direction of the rising space 98A). This structure makes it possible to reduce the volume of the rising space 98A, which is a portion of the outdoor heat exchanger 11 other than the portion contributing to heat exchange with the air flowing outside, such as the internal space of the multiport flat tube 63, and which is a portion difficult to contribute to heat exchange and makes it possible to reduce the amount of refrigerant required for the refrigerant circuit 6 to which the outdoor heat exchanger 11 is connected. Note that the width of the insertion plate member 293 in the air flow direction is set so as to be the same as the width in the air flow direction of each of the locking protrusions 295*s* of the rising division member 295 and the width of the regulating plate member 275.

The caulking member 292 is formed into a U-shape, as viewed in the longitudinal direction, so as to cover and integrate the front and back surfaces in the air flow direction of the insertion plate member 293, the regulating plate member 275, and the locking protrusions 295*s* of the rising division member 295 and the surfaces of the members facing the multiport flat tubes 63. That is, the caulking member 292 includes an inner side surface 292*p* which extends parallel to the insertion plate member 293 on the multiport flat tube 63 side of the insertion plate member 293, two surrounding portions 292*r* one extending from the front end in the air flow direction of the inner side surface 292*p* and the other from the rear end in the air flow direction of the inner side surface 292*p* in a direction away from the multiport flat tube 63, and locking portions 292*s* extending from the ends of the surrounding portions 292*r* remote from the multiport flat tube 63 in directions in which the locking portions 292*s* are closer to each other. Note that the openings 292*a* to 292*g* having sizes that match the sizes of the insertion spaces 271*a* to 271*g* of the insertion plate member 293, respectively, are formed even in the inner side surface 292*p*. According to the structure, in the caulking member 292, the locking portions 292*s* lock the locking protrusions 295*s* of the rising division member 295 with the insertion plate member 293, the regulating plate member 275, and the locking protrusions 295*s* of the rising division member 295 being inside of the rising division member 295. Thus, the insertion plate member 293, the regulating plate member 275, the rising division member 295, and the caulking member 292 can be integrated into one body.

As illustrated in FIG. 13, the partition plates 92 are provided so as to constitute the upper end surface and the lower end surface of the first upper section turned-back communication space 90A of the second header collecting pipe 290. Although the detailed shape of the partition plate 92 differs from that of the above-described embodiments, the partition plate 92 is used under assumption that the partition plate 92 has a function the same as that of the above-described embodiments. In addition, like the above-described embodiments, the nozzle-equipped division plate 96 extends parallel to the partition plate 92 that constitutes the lower end surface of the first upper section turned-back communication space 90A of the second header collecting pipe 290 between the partition plate 92 and a lower communication port 259*b*. Note that the introduction space 97 is formed between the partition plate 92 constituting the lower end surface of the first upper section turned-back communication space 90A of the second header collecting pipe 290 and the nozzle-equipped division plate 96, and the refrigerant is introduced into the introduction space 97 through the refrigerant connection pipe 24 connected to the falling space forming member 291. Here, a connection port 295*c* is provided in the circulation division portion 295*p* of the rising division member 295 so that a portion of the introduction space 97 adjacent to the multiport flat tube 63 communicates with a portion of the introduction space 97 adjacent to the refrigerant connection pipe 24. Note that the nozzle-equipped division plate 96 is provided with the nozzle 96*a* that enables the introduction space 97 to communicate with the rising space 98A in the rising space 98A.

In the structure of the second header collecting pipe 290 described above, the flow of the refrigerant in each of the spaces is the same as that described in the above embodiments.

In the second header collecting pipe 290, the insertion plate member 293, the regulating plate member 275, the rising division member 295, and the caulking member 292 are integrated into one body. When the multiport flat tubes 63 are inserted into the openings 292*a* to 292*g* of the inner side surface 292*p* of the caulking member 292 and the insertion spaces 271*a* to 271*g* of the insertion plate member 293, the front ends of the multiport flat tubes 63 cannot pass through the connection spaces 275*a* to 275*g* of the regulating plate member 275. Accordingly, the insertion is stopped at least in front of the regulating plate member 275 (note that all of the plurality of multiport flat tubes 63 need not be in contact with the regulating plate member 275, and some of the multiport flat tubes 63 may be stopped in front of the regulating plate member 275). In this manner, in plan view, insertion of the multiport flat tubes 63 up to at least a position at which the multiport flat tube 63 overlaps the rising space 98A can be prevented. As a result, an advantage of easily ensuring the prescribed area serving as the refrigerant passage area of the rising space 98A (the passage area for the rising flow) can be obtained. In addition, formation of the structure for achieving the advantage is facilitated by using the regulating plate member 275 that is separated from the rising division member 295 and the like that constitute the rising space 98A.

(7-7) Modification G

Modification F has been described with reference to the case where the width in the air flow direction of the rising space 98A and the width in the air flow direction of the falling space 98B are the same as an example.

Figure 16:
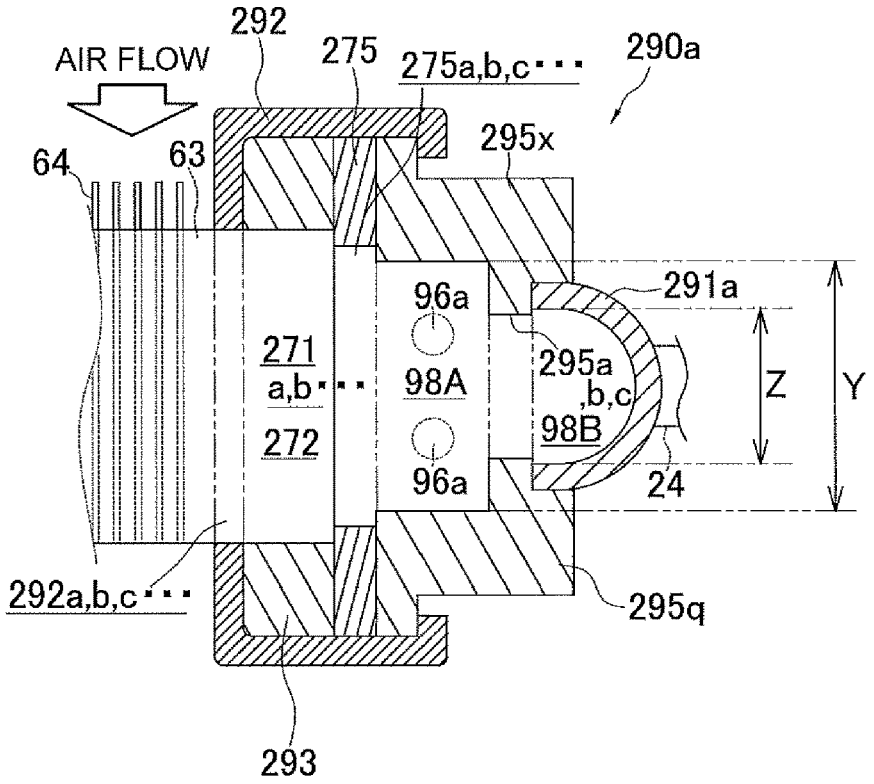
FIG. 16 is a schematic sectional configuration diagram of a header collecting pipe according to modification G located at a height at which a multiport flat tube is located, as viewed from above.

In contrast, for example, as in a second header collecting pipe 290*a* illustrated in FIG. 16, a structure is employed that uses a falling space forming member 291*a* that is smaller than the falling space forming member 291 according to modification F while using a rising division member 295*x* having a smaller width in the air flow direction than that of the falling space forming member 291 according to modification F for each of the clamping portions 295*q*. Thus, the width Z in the air flow direction of the falling space 98B can be made smaller than the width Y in the air flow direction of the rising space 98A. In the above-described manner, in addition to reducing the volume of the falling space 98B, which is a portion other than a portion contributing to heat exchange with the air flowing outside, such as the internal space of the multiport flat tubes 63 of the outdoor heat exchanger 11 and which is a portion difficult to contribute to heat exchange, the structure can reduce the volume of the falling space 98B, which is an auxiliary flow path, not the main flow path of the refrigerant. Consequently, the amount of refrigerant required for the refrigerant circuit 6 to which the outdoor heat exchanger 11 is connected can be reduced.

(7-8) Modification H

Modification G has been described above with reference to the case where the width Z of the falling space 98B in the air flow direction is smaller than the width Y of the rising space 98A in the air flow direction as an example.

Figure 17:
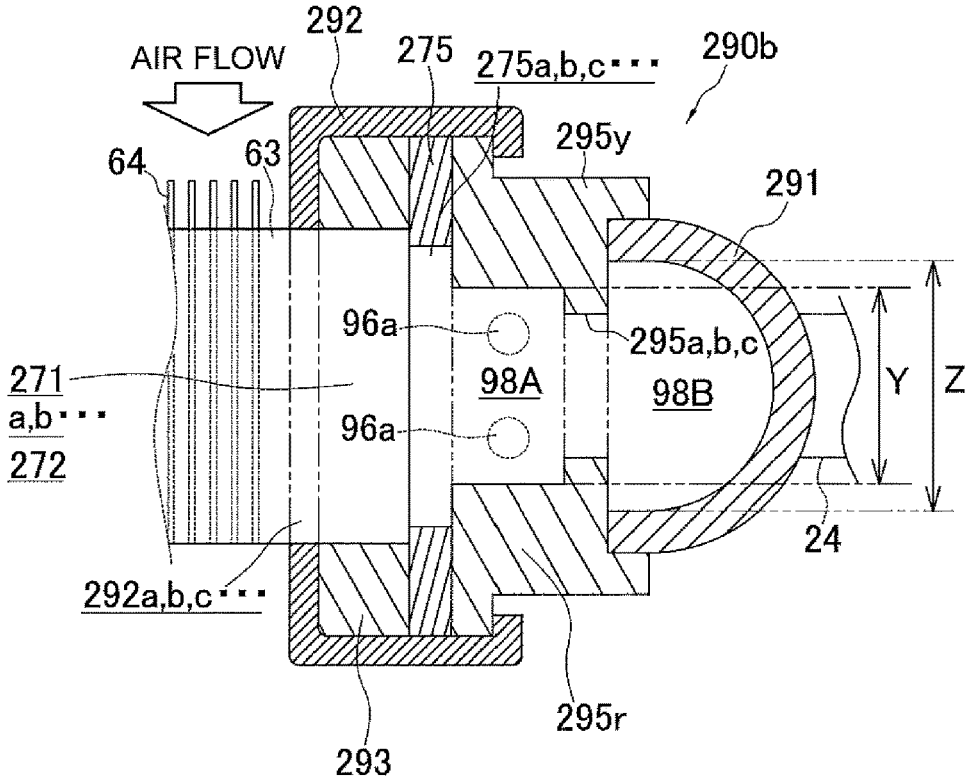
FIG. 17 is a schematic sectional configuration diagram of a header collecting pipe according to modification H located at a height at which a multiport flat tube is located, as viewed from above.

In contrast, for example, as in the case of a second header collecting pipe 290*b* illustrated in FIG. 17, a rising division member 295*y* may be employed in which the distance between surfaces facing each other to constitute the rising space 98A of the rising space forming portion 295*r* is reduced. As a result, the width Z in the air flow direction of the falling space 98B can be made larger than the width Y in the air flow direction of the rising space 98A. In the above-described manner, the refrigerant passage area of the falling space 98B through which a larger amount of gas refrigerant flows than in the rising space 98A can be increased. As a result, the pressure loss that occurs when the refrigerant passes through the falling space 98B can be reduced and, thus, the refrigerant can easily move downward in the falling space 98B.

(7-9) Modification I

The above embodiments and modifications have been described with reference to, as an example, the insertion division plate 75 in which the centers of the flow dividing openings 75*a* to 75*h* are disposed at substantially the center positions of the width of the multiport flat tubes 63 in the air flow direction or the regulating plate member 275 or the like in which the centers of the connection spaces 275*a* to 275*g* are disposed at substantially the center positions of the widths in the air flow direction of the multiport flat tubes 63.

Figure 18:
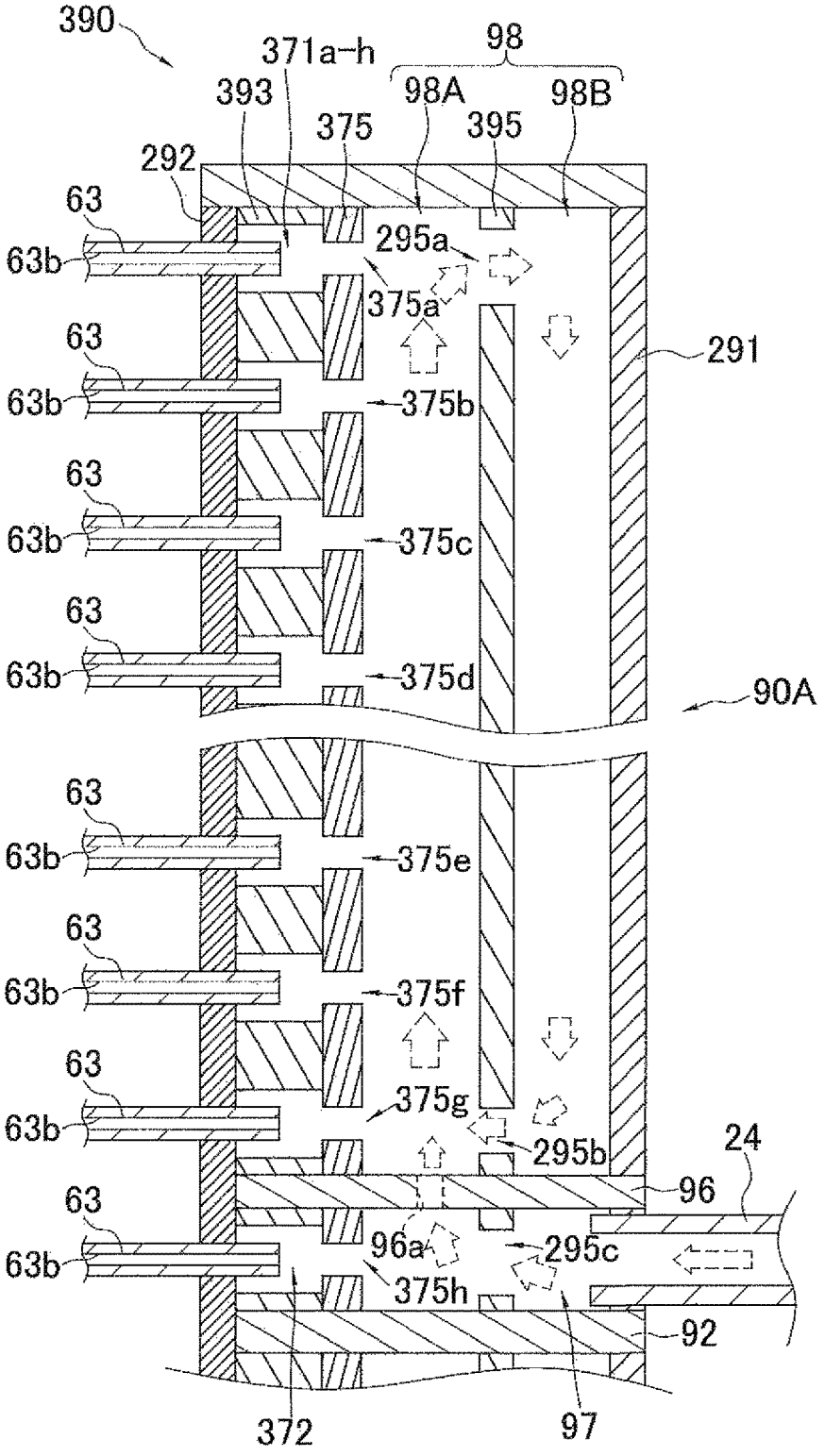
FIG. 18 is a schematic sectional configuration diagram of a header collecting pipe according to modification I, as viewed in the air flow direction.
Figure 19:
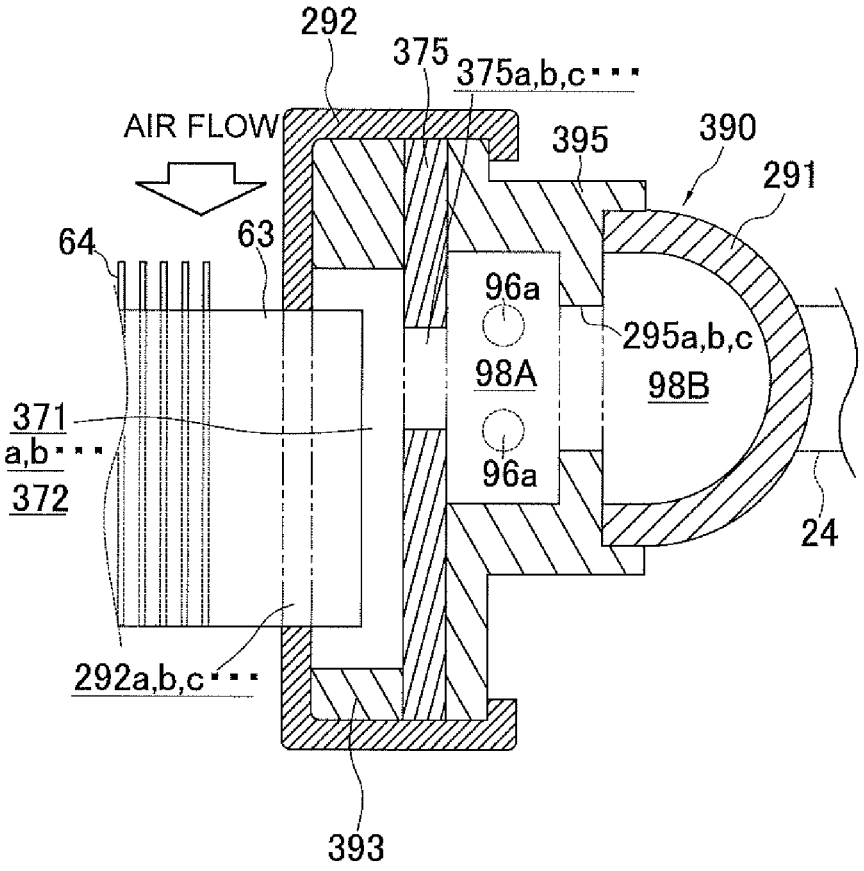
FIG. 19 is a schematic sectional configuration diagram of a header collecting pipe according to modification I located at a height at which a multiport flat tube is located, as viewed from above.

In contrast, as in a second header collecting pipe 390 illustrated in FIG. 18 and FIG. 19, a connection space forming plate member 375 may be provided. In the connection space forming plate member 375, the centers of connection spaces 375*a* to 375*g* are located on the windward side in the air flow direction of the substantially center positions in the air flow direction of the widths of the multiport flat tubes 63. Note that similarly, a rising division member 395 has a structure in which the center of the rising space 98A in plan view is shifted windward so that the center of the rising division member 395 corresponds to the connection spaces 375*a* to 375*g* arranged on the windward side.

The second header collecting pipe 390 includes an insertion plate member 393 that is not in contact with both ends of the multiport flat tube 63 in the air flow direction. The insertion plate member 393 has insertion spaces 371*a* to 371*g* each having a width between the upstream-side end and the downstream-side end in the air flow direction which is larger than that of the insertion spaces 271*a* to 271*g* of the insertion plate member 293 according to modification F. The multiport flat tubes 63 to be inserted into and connected to the second header collecting pipe 390 are inserted such that the front ends of the multiport flat tubes 63 in the insertion direction are not in contact with the connection space forming plate member 375. In this manner, clogging of the front ends of the multiport flat tubes 63 in the insertion direction with portions of the connection space forming plate member 375 where the connection spaces 375*a* to 375*g* are not formed can be prevented. In addition, the refrigerant that has flowed through the rising space 98A passes through the connection spaces 375*a* to 375*g* which are eccentrically located on the windward side. Thereafter, the refrigerant can be sent to the passages 63*b* of the multiport flat tubes 63 via the insertion spaces 371*a* to 371*g*. At this time, a large amount of refrigerant can be led to the passages 63*b* located on the windward. As a result, the heat exchange performance of the outdoor heat exchanger 11 can be improved.

In addition, the structure for leading a large amount of refrigerant to the windward side can be achieved simply by eccentrically placing, on the windward, the connection spaces 375*a* to 375*g* that pass through the connection space forming plate member 375 in the thickness direction.

(7-10) Modification J

Modification I has been described with reference to, as an example, the case where the connection space forming plate member 375 and the insertion plate member 393 are provided as separate members.

Figure 20:
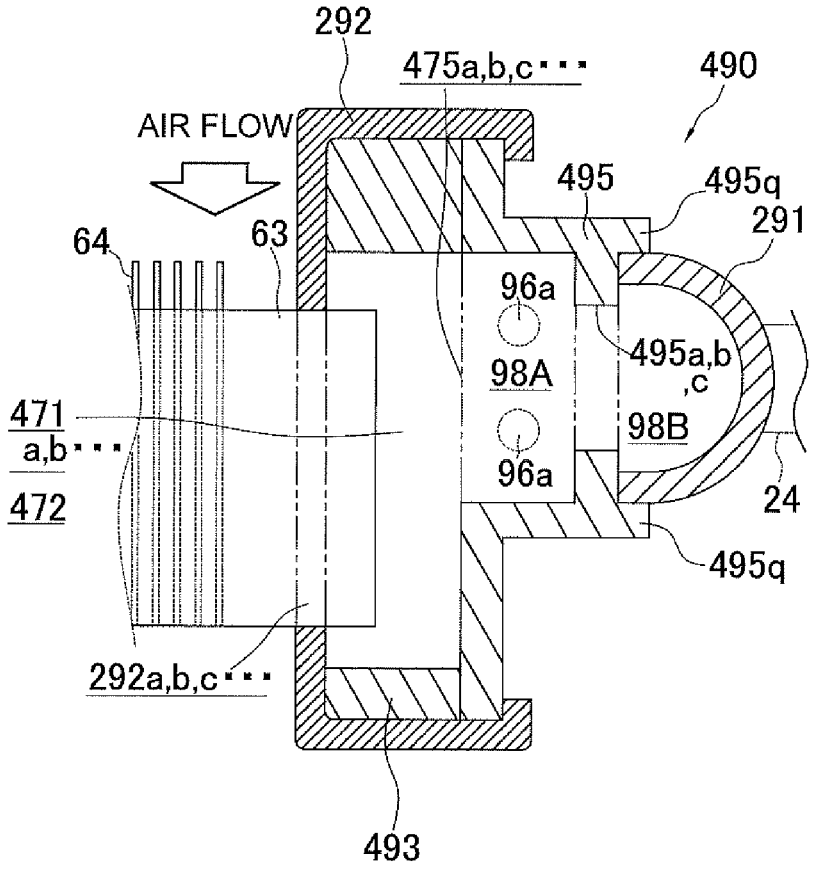
FIG. 20 is a schematic sectional configuration diagram of a header collecting pipe according to modification J located at a height at which a multiport flat tube is located, as viewed from above.

In contrast, as in a second header collecting pipe 490 illustrated in FIG. 20, an insertion plate member 493 may be provided. The insertion plate member 493 does not include a member for forming a connection space, such as the connection space forming plate member 375 described in modification I, and is formed as a single member corresponding to the insertion plate member 393 described in modification I. Like the insertion plate member 293 according to the above-described embodiments, the insertion plate member 493 is provided with insertion spaces 471*a* to 471*g* and an insertion space 472 arranged in the up-down direction so as to correspond to the multiport flat tubes 63 in a one-to-one manner.

In addition, the second header collecting pipe 490 is formed as a single member corresponding to the rising division member 295 according to the above-described embodiments. The second header collecting pipe 490 includes a rising division member 495 extending in the longitudinal direction of the second header collecting pipe 490. The end of the rising division member 495 adjacent to the multiport flat tube 63 is in contact with a portion of the insertion plate member 493 remote from the multiport flat tube 63.

Here, the windward ends of the insertion spaces 471*a* to 471*g* and the insertion space 472 formed inside the insertion plate member 493 are located at the same position as the windward end of the rising space 98A formed inside the rising division member 495 in the air flow direction. The leeward ends of the insertion spaces 471*a* to 471*g* and the insertion space 472 are located on the leeward side of the leeward end of the rising space 98A in the air flow direction. According to the structure, a leeward portion of the rising division member 495 constitutes wall surfaces of the leeward portions of the insertion spaces 471*a* to 471*g* and the insertion space 472 remote from the multiport flat tubes 63. According to the structure, in an end portion of the insertion spaces 471*a* to 471*g* and the insertion space 472 remote from the multiport flat tubes 63, a portion that is not closed by the leeward end portion of the rising division member 495 forms connection opening surfaces 475*a* to 475*g* that connect the rising space 98A with the insertion spaces 471*a* to 471*g*. That is, in the air flow direction, the windward ends and the leeward ends of the connection opening surfaces 475*a* to 475*g* are located so as to coincide with the windward end and the leeward end of the rising space 98A, respectively. In addition, the connection opening surfaces 475*a* to 475*g* are disposed with respect to the multiport flat tubes 63 so as to be eccentrically located on the windward side in the air flow direction. Here, the windward ends of the connection opening surfaces 475*a* to 475*g* are located on the windward side of the windward ends of the multiport flat tubes 63.

According to the above-described structure, like modification I, a large amount of refrigerant that has passed through the connection opening surfaces 475*a* to 475*g* can be sent to the windward side of the insertion spaces 471*a* to 471*g* and, thus, the performance of the outdoor heat exchanger 11 can be improved. Moreover, the connection opening surfaces 475*a* to 475*g* for leading the refrigerant to the multiport flat tubes 63 located on the windward side can be formed as a boundary between the rising division member 495 that forms the rising space 98A and the insertion plate member 493 that is a single member for forming the insertion spaces 471*a* to 471*g*, and edge portions of the connection opening surfaces 475*a* to 475*g* in the air flow direction can be formed by using the member that forms the rising space 98A.

Note that the rising division member 495 is formed such that the leeward end of a clamping portion 495*q* on the windward side is located at the same position as the windward end of the rising space 98A in the air flow direction. In addition, the windward end of the clamping portion 495*q* on the leeward side is located at the same position as the leeward end of the rising space 98A in the air flow direction. Furthermore, both ends of the falling space forming member 291 in the air flow direction are clamped by the clamping portions 495*q* of the rising division member 495. Still furthermore, like the above-described embodiments, the rising division member 495 includes an upper communication port 495*a* and a lower communication port 495*b*, and a connection port 495*c*. According to the above-described rising division member 495, the part shape can be simplified.

(7-11) Modification K

The above embodiments and modifications have been described with reference to, as an example, the outdoor heat exchanger 11 having only one multiport flat tube 63 disposed therein in the air flow direction.

In contrast, the outdoor heat exchanger 11 may have a plurality of multiport flat tubes 63 arranged therein in the air flow direction. For example, a plurality of multiport flat tubes 63 can be arranged in the air flow direction by arranging a plurality of headers in the air flow direction and connecting a plurality of multiport flat tubes 63 in parallel to the plurality of headers. According to the above-described structure, heat exchange of the refrigerant with the air can be performed more sufficiently.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 air conditioner apparatus
2 outdoor unit
11 outdoor heat exchanger (heat exchanger)
15 outdoor fan (fan)
63 multiport flat tube (heat transfer tube, flat tube)
64 fin
71 insertion space (insertion space)
75 insertion division plate (insertion space forming member)
75*a* to 75*h* flow dividing opening
77 dividing member (insertion space forming member)
79 flow dividing plate (insertion space forming member)
90 second header collecting pipe (header)
95 circulation division plate (circulation member)
96 nozzle-equipped division plate
96*a* nozzle (first opening)
98 circulation space
98A rising space (first space)
98B falling space (second space)
190 header collecting pipe (header)
271*a* to 271*g* insertion space
275 regulating plate member (insertion regulating member, insertion space forming member)
275*a* to 275*g* connection space
290 header collecting pipe (header)
290*a* header collecting pipe (header)

290*b* header collecting pipe (header)
291 falling space forming member (second space forming member)
292 caulking member
293 insertion plate member (insertion space forming member)
295 rising division member (circulation member)
295*x* rising division member (circulation member)
295*y* rising division member (circulation member)
371*a* to 371*g* insertion space
375 connection space forming plate member (insertion regulating member, insertion space forming member)
390 header collecting pipe (header)
393 insertion plate member (insertion space forming member)
395 rising division member (circulation member)
471*a* to 471*g* insertion space
475*a* to 475*g* connection opening surface
490 header collecting pipe (header)
493 insertion plate member
495 rising division member (circulation member, member for forming circulation space)
D gap
X width of rising space (width of first space)
Y width of multiport flat tube (width of heat transfer tube)
Z width of falling space (width of second space)

The invention claimed is:

1. A heat exchanger comprising:
heat transfer tubes aligned with one another;
a header connected to end portions of the heat transfer tubes; and
fins joined to the heat transfer tubes, wherein
when viewed in a longitudinal direction of the header, the header is divided into:
a circulation space comprising a first space in which refrigerant flows in a first direction along the longitudinal direction of the header and a second space in which the refrigerant flows in a second direction opposite to the first direction along the longitudinal direction, and
an insertion space into which the heat transfer tubes are inserted, the header comprises:
a circulation division plate that divides the first space from the second space; and
an insertion space forming plate that divides the circulation space from the insertion space, wherein
the insertion space forming plate forms a surface extending between the first space of the circulation space and the insertion space,
when viewed in the longitudinal direction of the header, the first space is between the circulation division plate and the insertion space forming plate,
the insertion space forming plate regulates a degree of insertion of the heat transfer tubes, and
in a direction perpendicular to an insertion direction of the heat transfer tubes when viewed in the longitudinal direction of the header, the insertion space forming plate is separated from portions of the header that constitute both ends of the first space in the direction perpendicular to the insertion direction.

2. The heat exchanger according to claim 1, wherein, in the direction perpendicular to the insertion direction of the heat transfer tubes when viewed in the longitudinal direction of the header, a width of the first space is smaller than a width of the heat transfer tubes.

3. The heat exchanger according to claim 1, wherein, when viewed in the longitudinal direction of the header, the header comprises a longitudinal shell that forms part of a contour of the second space and that is separated from the circulation division plate.

4. The heat exchanger according to claim 3, wherein
in a direction perpendicular to an insertion direction of the heat transfer tubes when viewed in
the longitudinal direction of the header:
the longitudinal shell constitutes at least both ends of the second space in the direction perpendicular to the insertion direction, and
a width of the second space is smaller than a width of the first space.

5. The heat exchanger according to claim 3, wherein
in a direction perpendicular to an insertion direction of the heat transfer tubes when viewed in
the longitudinal direction of the header:
the longitudinal shell constitutes at least both ends of the second space in the direction perpendicular to the insertion direction, and
a width of the second space is larger than a width of the first space.

6. An air conditioner apparatus comprising:
the heat exchanger according to claim 1, wherein,
in a direction perpendicular to an insertion direction of the heat transfer tubes when viewed in
the longitudinal direction of the header,
the circulation space is connected with the insertion space through connection spaces at a connection location in the header and
at the connection location, the connection spaces are eccentrically disposed on a windward side of the header.

7. The air conditioner apparatus according to claim 6, wherein
the header further comprises a plate that extends between the circulation space and the insertion space, and
the connection spaces are pass-through portions on the plate in a thickness direction of the plate.

8. An air conditioner apparatus comprising:
the heat exchanger according to claim 1, wherein
the circulation space and the insertion space are connected at connection opening surfaces of the insertion space in the header, and
in a direction perpendicular to an insertion direction of the heat transfer tubes when viewed in
the longitudinal direction of the header:
the connection opening surfaces are eccentrically disposed on a windward side of the header, and
both ends of the connection opening surfaces are disposed on a member of the header that constitutes the circulation space.

9. The heat exchanger according to claim 1, wherein when viewed in the longitudinal direction of the header:
in an inner peripheral portion of the header, an inner peripheral portion of the insertion space is semi-circular, and
in a direction perpendicular to the longitudinal direction of the heat transfer tubes, a gap is formed between an end of the heat transfer tubes and the inner peripheral portion of the insertion space.

10. The heat exchanger according to claim 1, wherein the insertion space forming plate extends in the insertion space between two adjacent ones of the heat transfer tubes.

11. The heat exchanger according to claim 1, wherein
the header further comprises an opening at an upstream end of the first space with respect to the first direction, the opening generates a flow of the refrigerant in the first direction, when viewed in the longitudinal direction of the header:

the first space is formed between the circulation division plate and the insertion space forming plate, and the opening does not overlap with the insertion space forming plate, and the insertion space forming plate extends in the insertion space between two adjacent ones of the heat transfer tubes.

12. The heat exchanger according to claim 1, wherein the insertion space forming plate extends parallel to the circulation division plate and divides the circulation space from the insertion space.

13. The heat exchanger according to claim 12, wherein the insertion space forming plate comprises flow dividing openings that correspond to the end portions of the heat transfer tubes.

14. An air conditioner apparatus comprising:

the heat exchanger according to claim 13; and a fan that generates an air flow around the heat exchanger, wherein the fan is arranged such that wind speed of wind passing through each part of the heat exchanger has a predetermined wind speed distribution, and a size of each of the flow dividing openings corresponds to the wind speed at a location of the each of the flow dividing openings.

15. The heat exchanger according to claim 1, wherein the heat transfer tubes are disposed in an up-down direction of the heat exchanger, the refrigerant flows upward in the first space and flows downward in the second space in the heat exchanger that functions as an evaporator, and the refrigerant flows downward in the first space and flows upward in the second space in the heat exchanger that functions as a condenser.

16. The heat exchanger according to claim 1, wherein the heat transfer tubes are flat tubes.

17. An air conditioner apparatus comprising:

the heat exchanger according to claim 1; and a fan that generates an air flow around the heat exchanger, wherein the heat exchanger comprises:

a first unit that comprises the heat transfer tubes as first heat transfer tubes and the header as a first header; and a second unit that comprises second heat transfer tubes and a second header, and the first unit is aligned with the second unit in a direction of the air flow.

* * * * *